US010927486B2

(12) United States Patent
Jung et al.

(10) Patent No.: US 10,927,486 B2
(45) Date of Patent: Feb. 23, 2021

(54) METHOD OF CONTROLLING LAUNDRY TREATMENT APPARATUS

(71) Applicant: LG ELECTRONICS INC., Seoul (KR)

(72) Inventors: Yanghoon Jung, Seoul (KR); Heechul Choi, Seoul (KR)

(73) Assignee: LG Electronics Inc., Seoul (KR)

( * ) Notice: Subject to any disclaimer, the term of this patent is extended or adjusted under 35 U.S.C. 154(b) by 519 days.

(21) Appl. No.: 15/797,247

(22) Filed: Oct. 30, 2017

(65) Prior Publication Data

US 2018/0119326 A1 May 3, 2018

(30) Foreign Application Priority Data

Oct. 31, 2016 (KR) ..... 10-2016-0143456

(51) Int. Cl.
*D06F 34/20* (2020.01)
*D06F 33/00* (2020.01)
(Continued)

(52) U.S. Cl.
CPC ..... *D06F 33/00* (2013.01); *D06F 25/00* (2013.01); *D06F 29/005* (2013.01); *D06F 37/18* (2013.01);
(Continued)

(58) Field of Classification Search
None
See application file for complete search history.

(56) References Cited

U.S. PATENT DOCUMENTS

2004/0211228 A1 10/2004 Nishio
2008/0159907 A1* 7/2008 Joshi ..... D06F 29/00 422/5
(Continued)

FOREIGN PATENT DOCUMENTS

KR 10-1999-0038082 6/1999
KR 10-2008-0040399 5/2008
(Continued)

OTHER PUBLICATIONS

Extended European Search Report in European Application No. 17199150.8, dated Feb. 6, 2018, 9 pages.

*Primary Examiner* — Michael E Barr
*Assistant Examiner* — Jason P Riggleman
(74) *Attorney, Agent, or Firm* — Fish & Richardson P.C.

(57) ABSTRACT

Disclosed is a control method of a laundry treatment apparatus including a cabinet defining an external appearance and having a front opening, a drawer provided to be discharged through the opening, a tub accommodated in the drawer to accommodate wash water therein, a drum rotatably provided inside the tub to accommodate laundry therein, a fastening unit configured to separably couple the drawer to the cabinet, and a sensing unit configured to sense whether the drawer is discharged from the cabinet, the method including receiving a control command to operate the laundry treatment apparatus, sensing whether insertion of the drawer into the cabinet is completed by controlling the sensing unit, locking the drawer to the cabinet by controlling the fastening unit, performing the control command, and releasing a locked state so as to separate the drawer from the cabinet by controlling the fastening unit when the control command is completely performed.

20 Claims, 12 Drawing Sheets

(51) Int. Cl.

| | |
|---|---|
| ***D06F 58/30*** | (2020.01) |
| ***D06F 25/00*** | (2006.01) |
| ***D06F 29/00*** | (2006.01) |
| ***D06F 37/18*** | (2006.01) |
| *D06F 39/14* | (2006.01) |
| *D06F 23/04* | (2006.01) |
| *D06F 37/42* | (2006.01) |

(52) U.S. Cl.
CPC ..... *D06F 58/30* (2020.02); *D06F 23/04* (2013.01); *D06F 29/00* (2013.01); *D06F 37/42* (2013.01); *D06F 39/14* (2013.01)

(56) References Cited

U.S. PATENT DOCUMENTS

2010/0307200 A1* 12/2010 Jeong ..... D06F 39/12 68/13 R
2014/0053612 A1* 2/2014 Son ..... D06F 29/00 68/28

FOREIGN PATENT DOCUMENTS

KR 10-2008-0060705 7/2008
KR 10-2008-0065752 7/2008
WO WO2016140472 A1 9/2016

* cited by examiner

【FIG. 1】
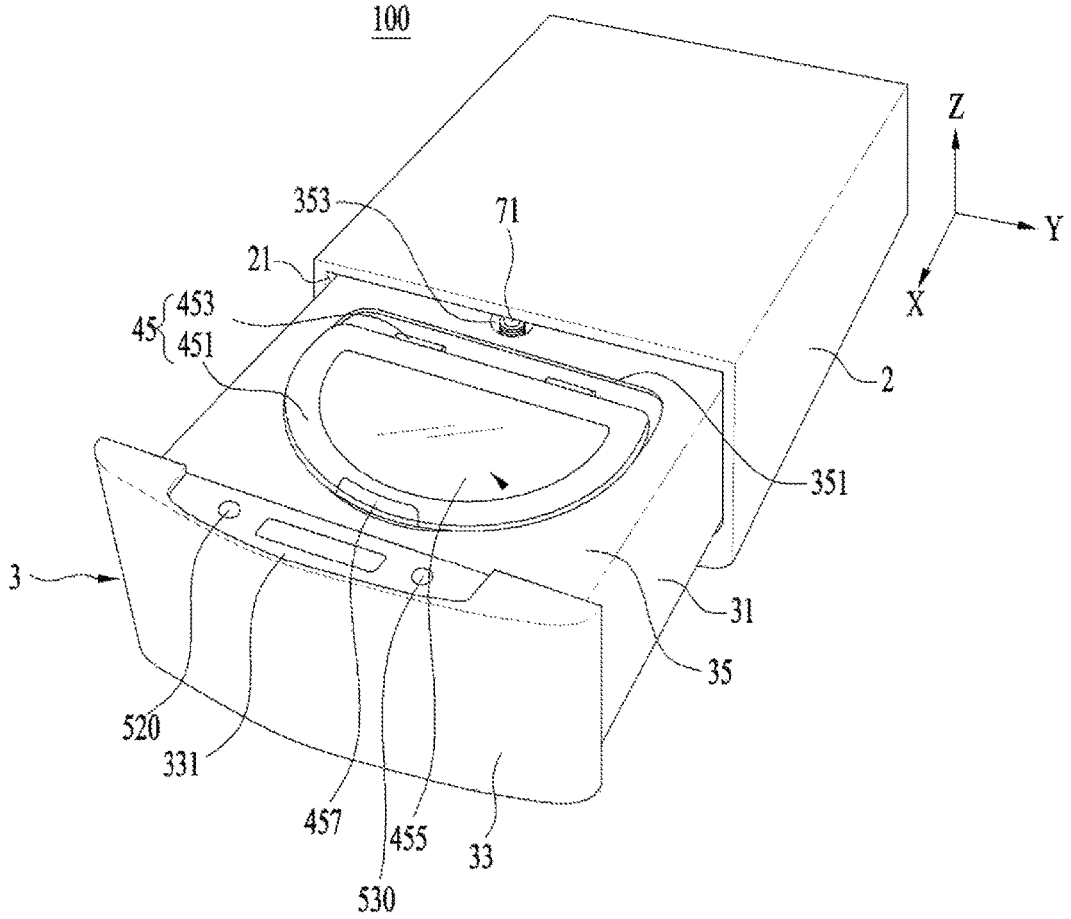

【FIG. 2】
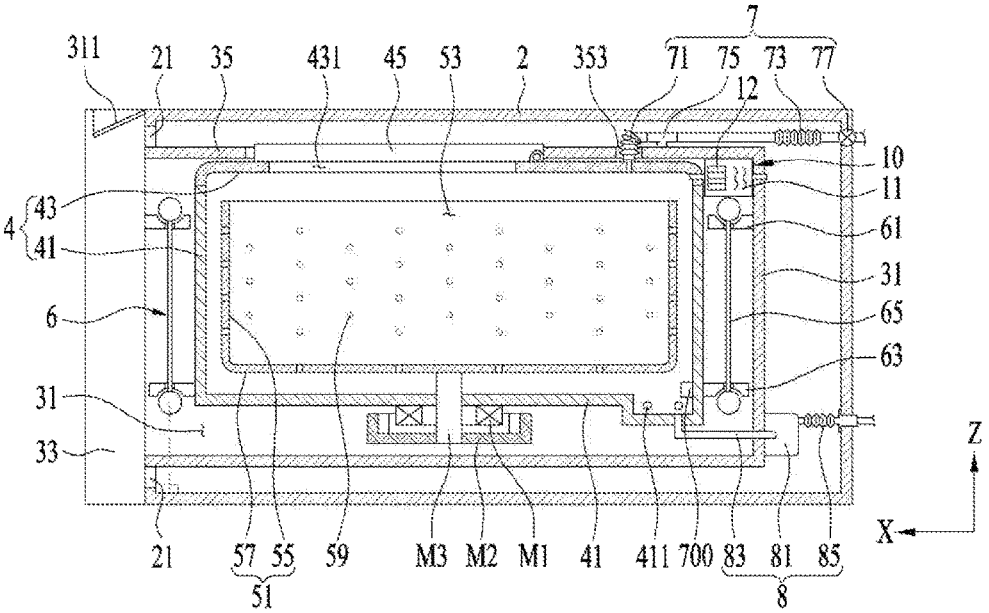

【FIG. 3】
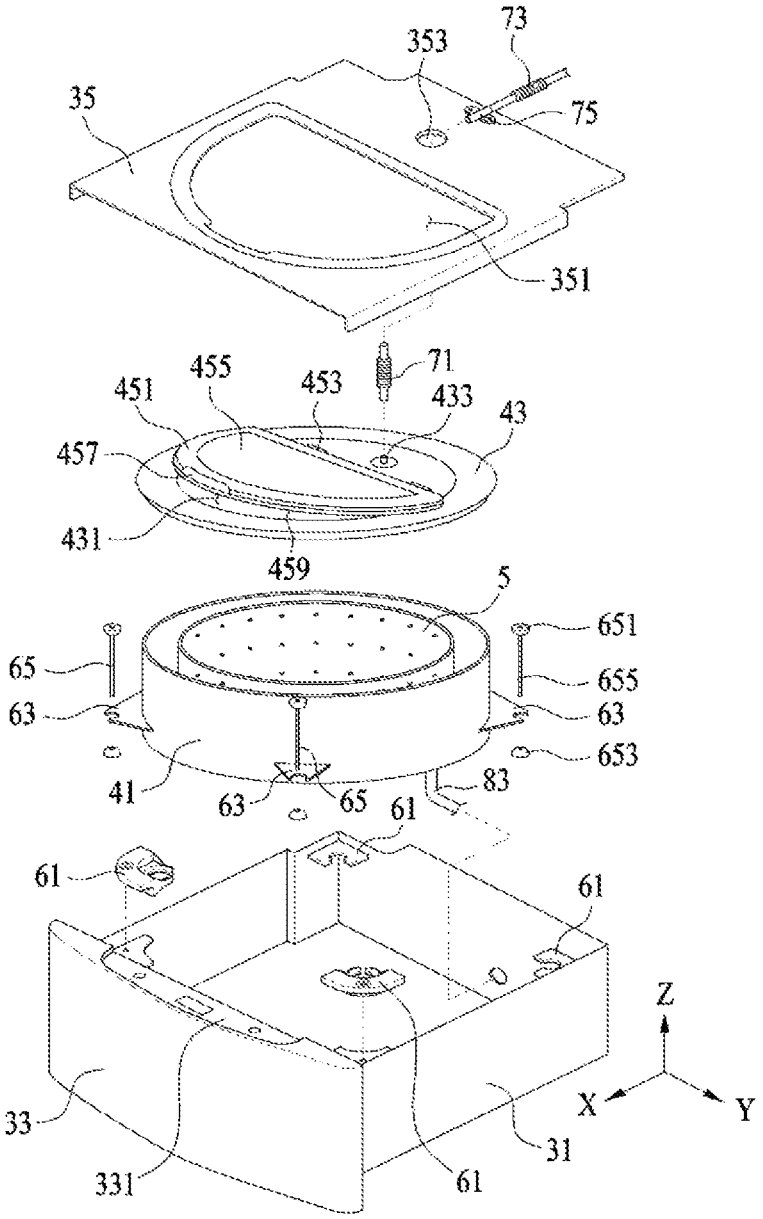

【FIG. 4】
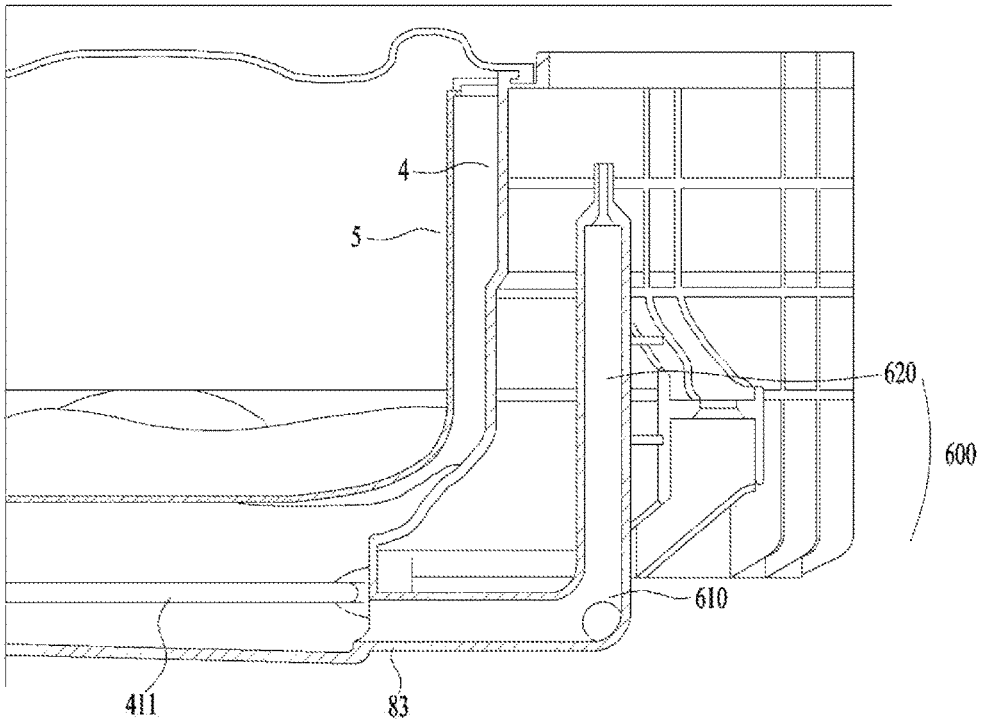

【FIG. 5】
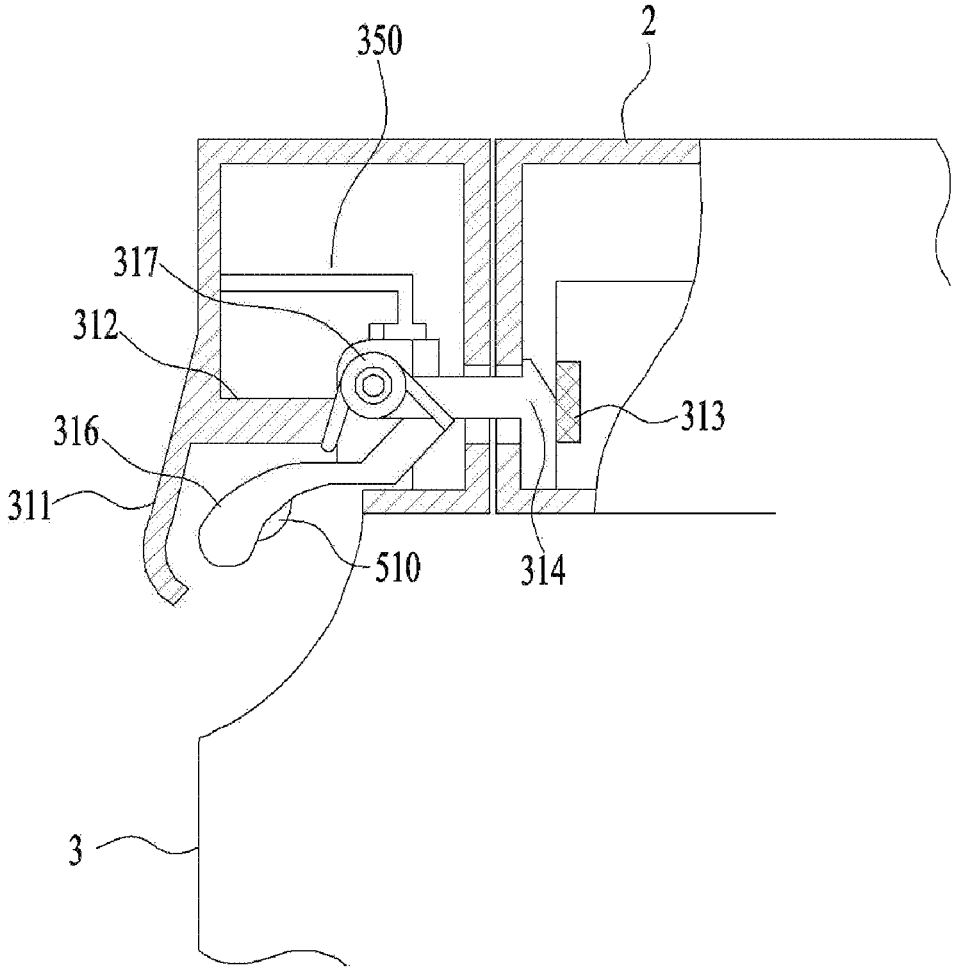

【FIG 6】
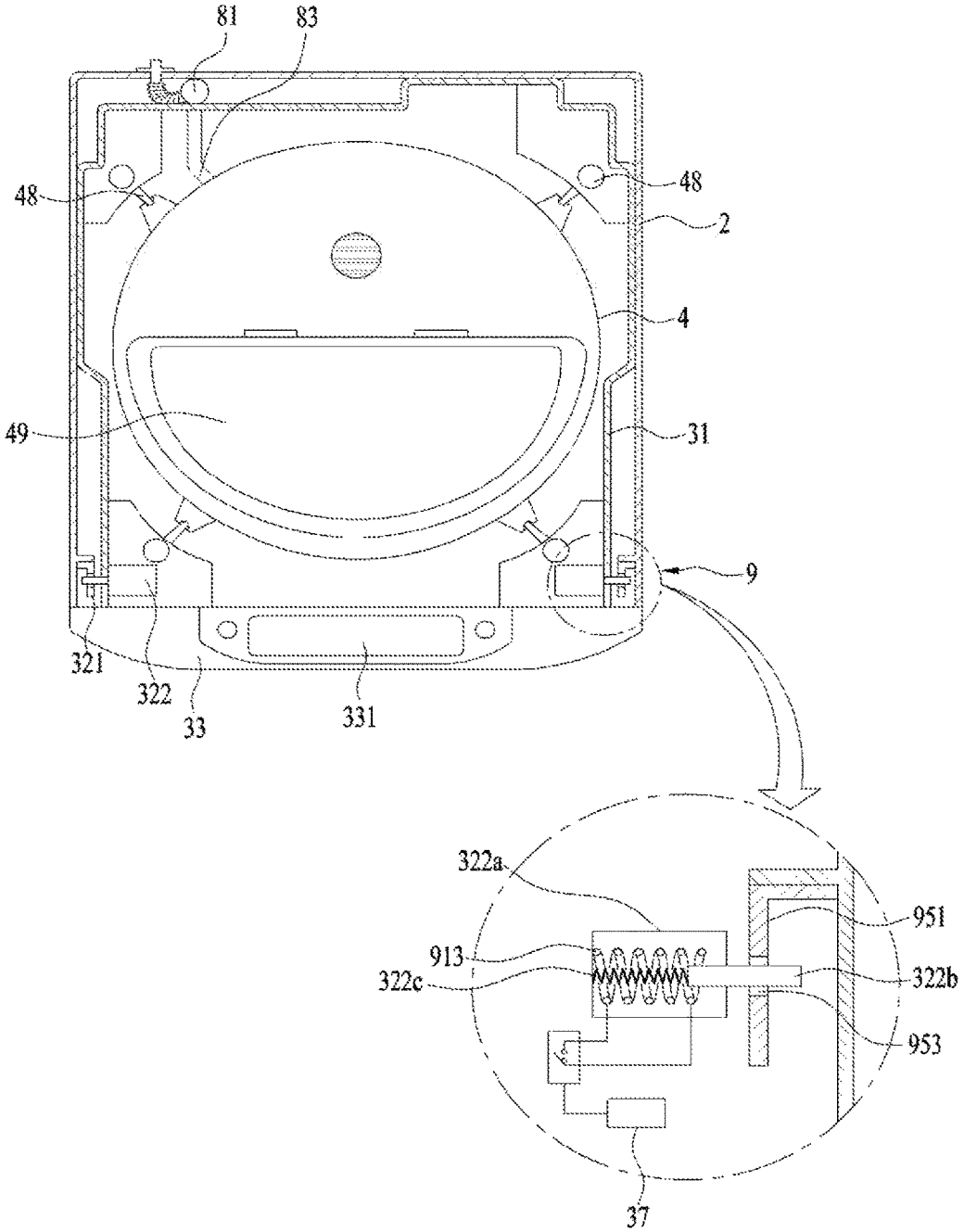

【FIG. 7】
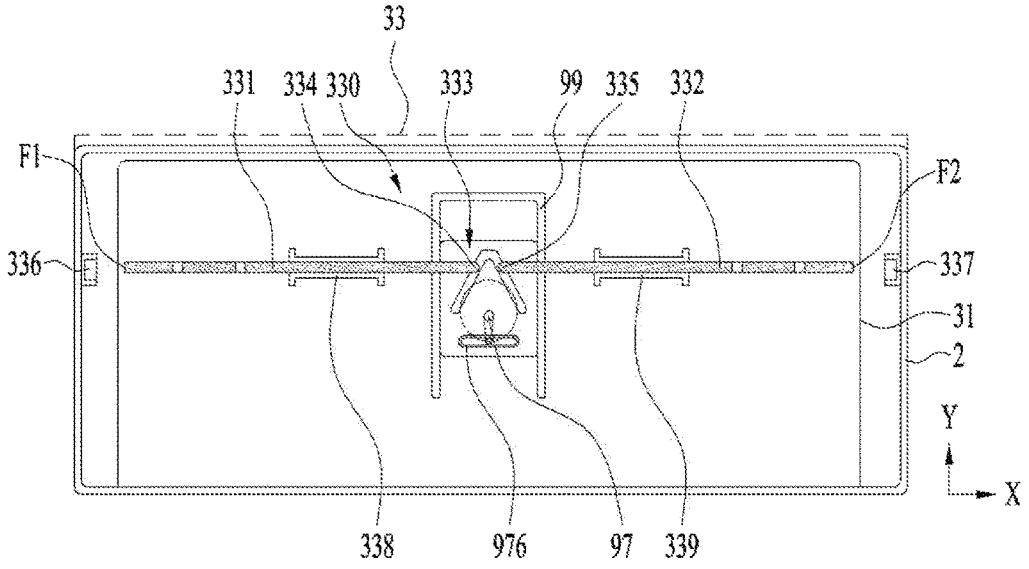
(a)
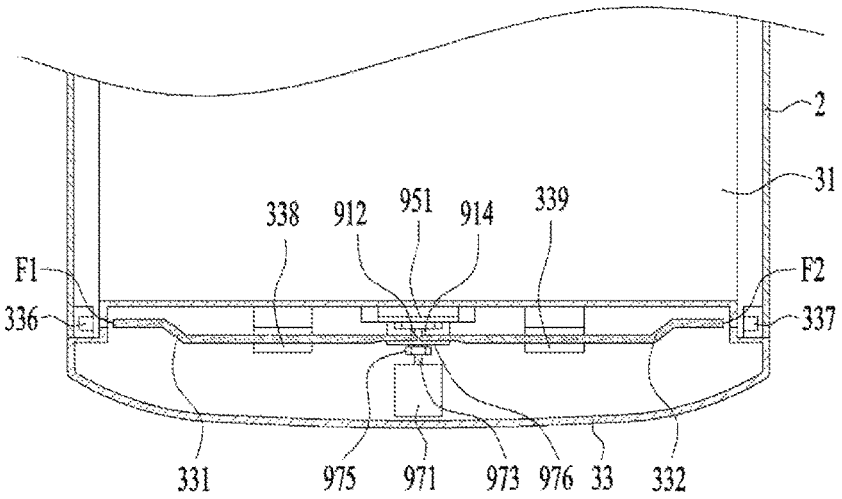
(b)

【FIG. 8】
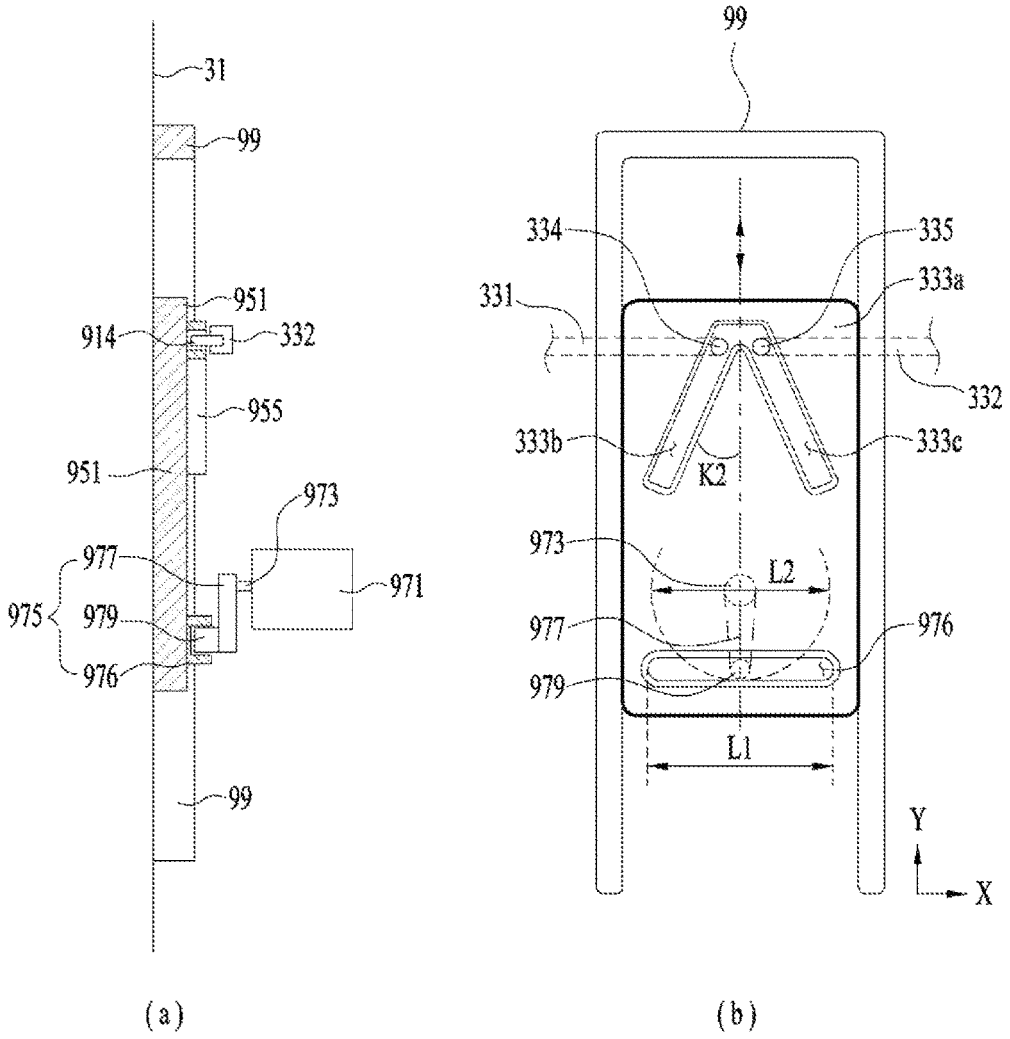

【FIG. 9】
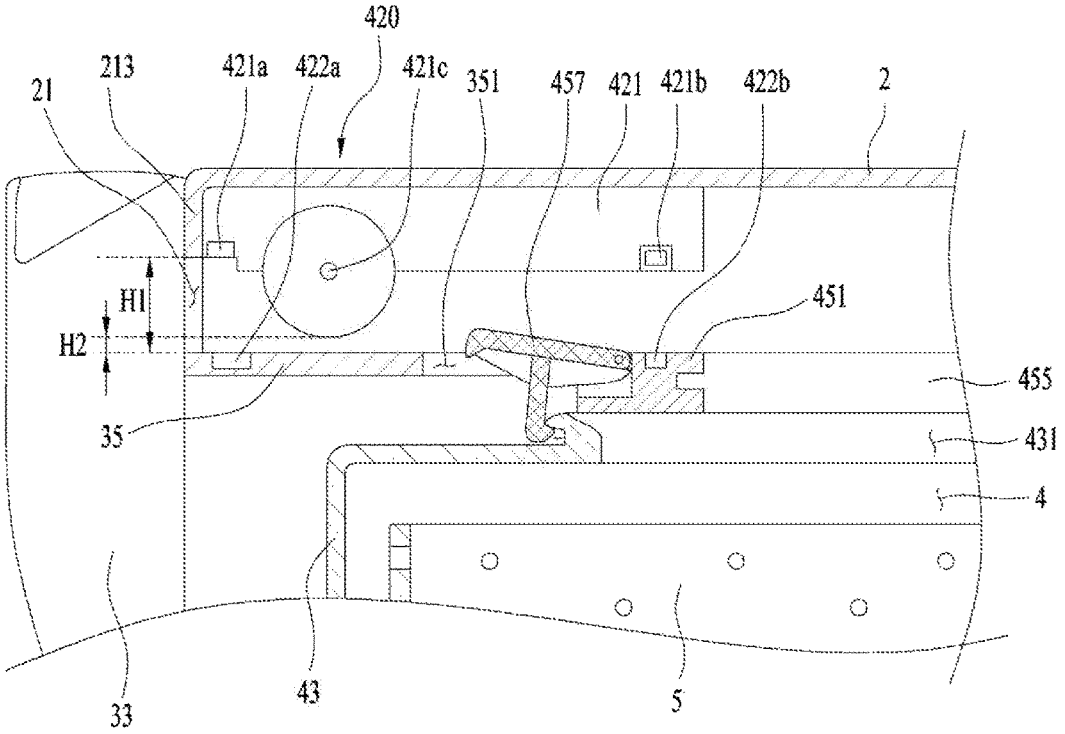

【FIG. 10】
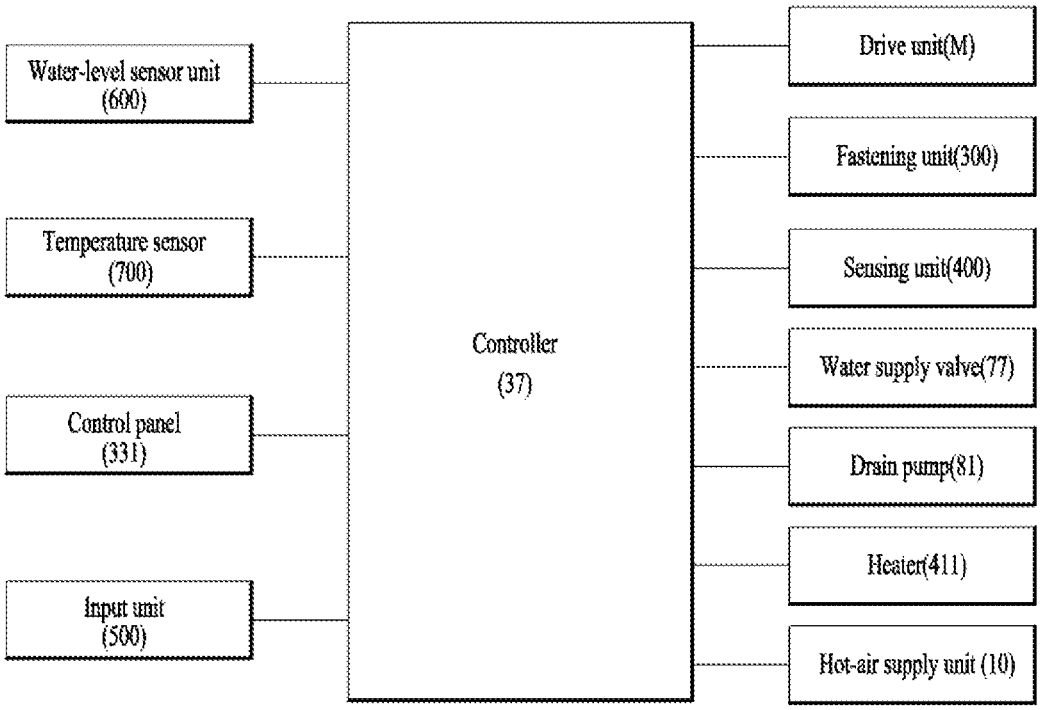

【FIG. 11】
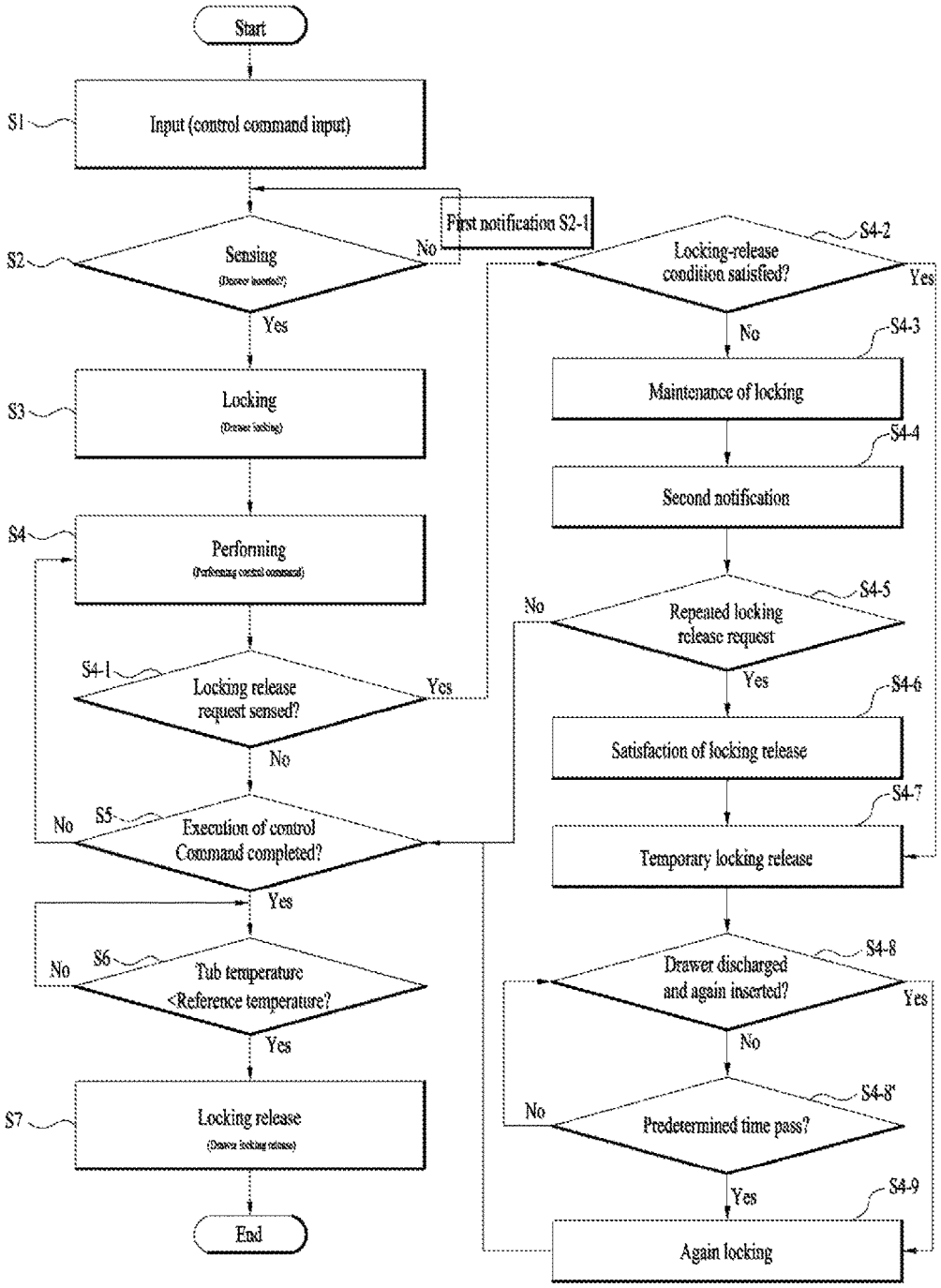

【FIG. 12】
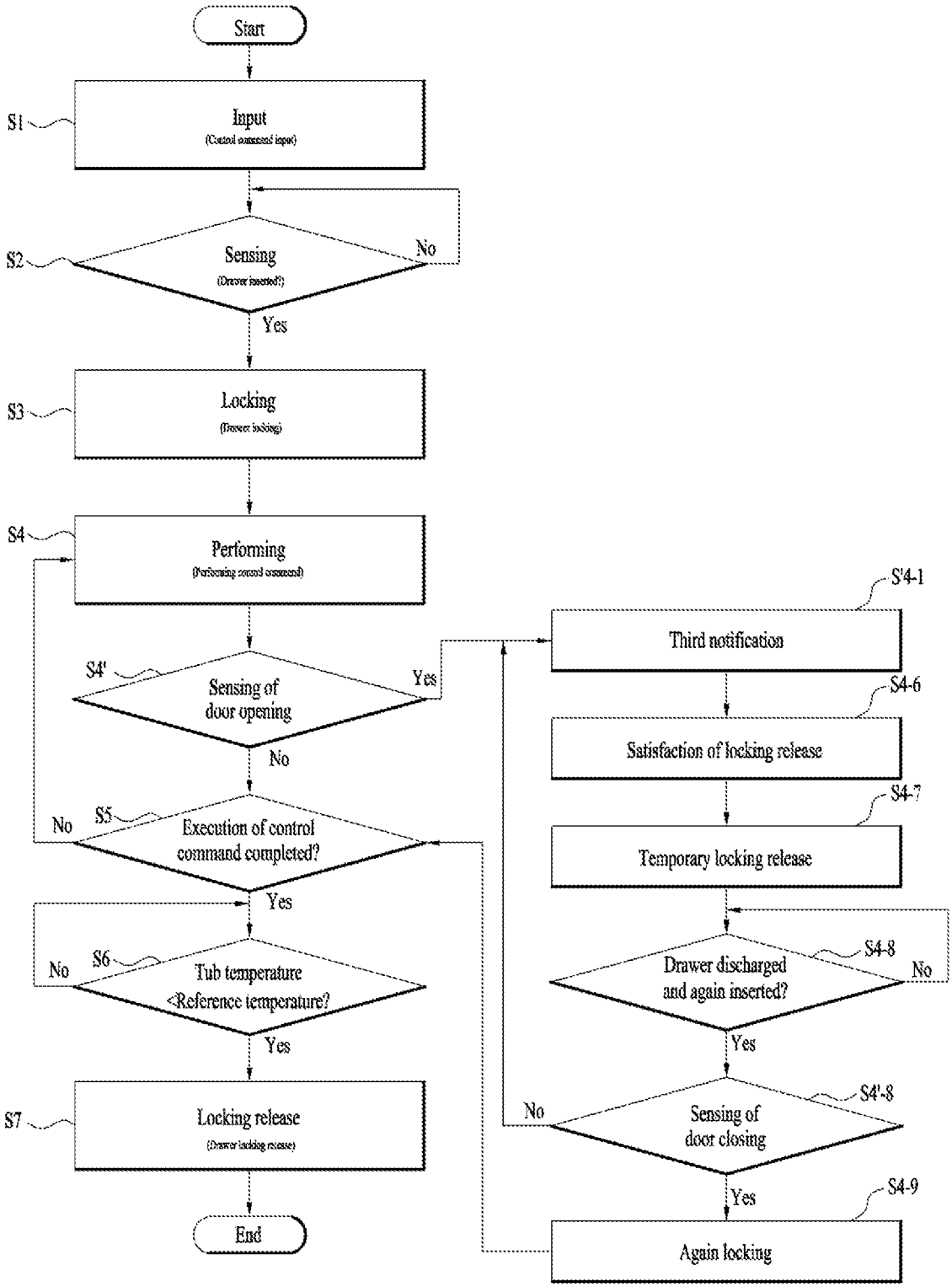

METHOD OF CONTROLLING LAUNDRY TREATMENT APPARATUS

This application claims the benefit of Korean Patent Application No. 10-2016-0143456, filed on Oct. 31, 2016, which is hereby incorporated by reference as if fully set forth herein.

BACKGROUND OF THE INVENTION

Field of the Invention

The present invention relates to a method of controlling a laundry treatment apparatus.

Discussion of the Related Art

Generally, a laundry treatment apparatus is an apparatus that may perform washing and/or drying of laundry, etc. Here, a laundry treatment apparatus may perform only a washing or drying function, or may perform both washing and drying functions. In addition, a washing machine, which includes a steam supply device and has refreshing functions such as, for example, wrinkle removal, deodorization, and antistatic functions, has recently been popularized.

Meanwhile, conventional laundry treatment apparatuses are divided into a front-loading type and a top-loading type, depending on the direction in which laundry is discharged. In addition, conventional laundry treatment apparatuses are divided into a vertical type in which a pulsator or a wash tub is rotated and a horizontal type in which a drum is rotated, depending on a washing method.

A representative example of the horizontal-type laundry treatment apparatus is a drum washing machine or a drum drying machine.

These laundry treatment apparatuses have recently been gradually increased in size to meet user demand. That is, the outer size of washing machines for household use becomes larger.

Each household usually owns and uses a single large-capacity laundry treatment apparatus. Therefore, when attempting to perform washing for respective types of laundry, the laundry treatment apparatus is used several times. For example, when attempting to wash laundry by separating laundry such as adult clothes from laundry such as underclothing or baby clothing, the laundry treatment apparatus must be again used for the washing of the latter after the washing of the former is completed.

Due to this, a large washing time is consumed and power consumption is also increased.

In addition, when a small amount of laundry is washed, it is not desirable, in terms of power savings, to use a conventional large laundry treatment apparatus. A washing course provided in the large laundry treatment apparatus assumes, in the main, the case where the amount of laundry is large, and thus consumes a large amount of water. Moreover, much power is consumed because it is necessary to rotate a large drum or inner tub.

The washing course further assumes a large amount of laundry, and thus has a relatively long washing time.

In addition, the large laundry treatment apparatus, further, provides washing courses under the assumption of general laundry, in the main. Therefore, the large laundry treatment apparatus may not be suitable for washing delicate fabrics such as underclothing or baby clothing.

The large laundry treatment apparatus is also not suitable in the case where a small amount of laundry needs to be washed frequently. Consumers tend to accumulate laundry for days or a longer duration in order to wash the laundry all at once.

It is not desirable, from the aspect of sanitation, to leave underclothing or baby clothing for a long time. When such laundry is left for a long time, contaminants adhere to fabrics, which prevents the laundry from being thoroughly washed.

Therefore, there is a demand for a small laundry treatment apparatus having a capacity much smaller than that of the conventional large laundry treatment apparatus.

Even if it is small, it is not desirable from the aspect of space utilization or from the aspect of aesthetic appearance for two laundry treatment apparatuses to be arranged side by side in a house.

To solve this problem, a drawer-type laundry treatment apparatus has recently appeared.

A conventional drawer-type laundry treatment apparatus includes a drawer, which is introduced into or discharged from a cabinet having an opening in the front side thereof.

The drawer-type laundry treatment apparatus may be used alone or along with another laundry treatment apparatus coupled to the top or bottom thereof, and may perform washing of a small amount of laundry and enhance space utilization.

The drawer-type laundry treatment apparatus generally includes a tub provided in the drawer for storing wash water therein and a drum rotatably provided in the tub.

Here, the drawer-type laundry treatment apparatus needs to be locked during operation thereof such as, for example, during the supply or discharge of water to or from the tub, during steam supply, or during drum rotation, in order to ensure that the drawer is fixed to and not separated from the cabinet in the state in which it is completely inserted into the cabinet.

This is because, when the drawer is not completely inserted into the cabinet or is not locked, thereby being discharged from the cabinet to thereby be exposed outward during operation of the laundry treatment apparatus, various accidents may occur, such as, for example, the laundry treatment apparatus may be turned over by the weight of water and laundry inside the tub, a user may be scalded when exposed to the high-temperature environment inside the tub, the water supplied to or discharged from the tub may leak to the outside of the laundry treatment apparatus, or the user's body may be injured by touching or colliding with the drum that is rotating.

In the conventional drawer-type laundry treatment apparatus, the drawer may be discharged from the cabinet during rotation of the drum, which may expose the user's body to the rotation of the drum, thereby leading to injury. In the state in which the drawer is discharged, the drawer may severely vibrate and be damaged by vibration of the drum, or the water stored in the tub may leak outward.

In addition, in the conventional drawer-type laundry treatment apparatus, when the drawer is discharged from the cabinet during the supply or discharge of water to or from the tub, the water stored in the tub may vibrate and leak outward, or the level of water in the tub may be rapidly changed, which may prevent the efficient supply and discharge of water.

In addition, in the conventional drawer-type laundry treatment apparatus, when the drawer is discharged from the cabinet in the state in which water is supplied to the tub to a reference water level or more, the cabinet may be turned over by the weight of the tub and the water.

In addition, in the conventional drawer-type laundry treatment apparatus, when the drawer is discharged from the cabinet in the state in which the temperature inside the tub is a reference temperature or more, the user may be exposed to hot air, thereby being injured.

In addition, in the conventional drawer-type laundry treatment apparatus, when the drawer is discharged from the cabinet in the state in which steam or hot air is supplied into the tub, the same result as that in the state in which the temperature is the reference temperature or more may occur.

Meanwhile, the conventional drawer-type laundry treatment apparatus may not permit the locking of the drawer unconditionally during operation, thus preventing the user from freely manipulating the same, or may not smoothly deal with special situations such as the situation in which the user needs to additionally introduce laundry, or needs to introduce a detergent or fabric softener.

SUMMARY OF THE INVENTION

Accordingly, the present invention is directed to a method of controlling a laundry treatment apparatus that substantially obviates one or more in problems due to limitations and disadvantages of the related art.

One object of the present invention is to provide a method of controlling a drawer-type laundry treatment apparatus, which may perform the locking of a drawer by sensing whether the drawer is completely inserted into a cabinet.

In addition, another object of the present invention is to provide a method of controlling a drawer-type laundry treatment apparatus, which may perform the locking of a drawer so as to ensure that the drawer is fixed to and is not separated from the cabinet during operation of the laundry treatment apparatus such as, for example, during the supply or discharge of water to or from a tub, during steam or hot air supply, or during drum rotation.

In addition, another object of the present invention is to provide a method of controlling a drawer-type laundry treatment apparatus, which may release the locking of a drawer so as to allow the drawer to be discharged from the cabinet when the operation of the laundry treatment apparatus, such as the supply or discharge of water to or from a tub, the supply of steam or hot air, or the rotation of a drum, is completed.

In addition, another object of the present invention is to provide a method of controlling a drawer-type laundry treatment apparatus, which may determine whether or not to permit the discharge of a drawer in consideration of the possibility of occurrence of an accident when sensing the user's intention to discharge the drawer during the operation of the laundry treatment apparatus.

In addition, another object of the present invention is to provide a method of controlling a drawer-type laundry treatment apparatus, which may maintain the locking of a drawer based on the determination that there is the risk of an accident when sensing the user's intention to discharge the drawer during the operation of the laundry treatment apparatus.

In addition, another object of the present invention is to provide a method of controlling a drawer-type laundry treatment apparatus, which may remove risk factors that may cause accidents, and may permit the discharge of a drawer when sensing the user's intention to discharge the drawer during the operation of the laundry treatment apparatus.

In addition, another object of the present invention is to provide a method of controlling a drawer-type laundry treatment apparatus, which may release the locking of a drawer and may secure the autonomy of the user based on the determination that there is no possibility of occurrence of an accident when sensing the user's intention to discharge the drawer during the operation of the laundry treatment apparatus.

In addition, a further object of the present invention is to provide a method of controlling a drawer-type laundry treatment apparatus, which may prevent accidents and damage to the laundry treatment apparatus by sensing whether a door, which is used to open or close the inlet of a tub, is opened or closed during the operation of the laundry treatment apparatus, and inducing a user to close the door.

Additional advantages, objects, and features will be set forth in part in the description which follows and in part will become apparent to those having ordinary skill in the art upon examination of the following or may be learned from practice. The objectives and other advantages may be realized and attained by the structure particularly pointed out in the written description and claims hereof as well as the appended drawings.

To achieve these objects and other advantages and in accordance with the purpose of the invention, as embodied and broadly described herein, in accordance with an aspect of the present invention, there is provided a control method of a laundry treatment apparatus, the laundry treatment apparatus including a cabinet defining an external appearance of the apparatus and having a front opening, a drawer provided so as to be discharged through the opening, a tub accommodated in the drawer so as to accommodate wash water therein, a drum rotatably provided inside the tub so as to accommodate laundry therein, a fastening unit configured to separably couple the drawer to the cabinet, and a sensing unit configured to sense whether or not the drawer is discharged from the cabinet, the method including receiving a control command to operate the laundry treatment apparatus, sensing whether or not insertion of the drawer into the cabinet is completed by controlling the sensing unit, locking the drawer to the cabinet by controlling the fastening unit, performing the control command, and releasing a locked state so as to separate the drawer from the cabinet by controlling the fastening unit when the control command is completely performed.

The control command may include at least one of rotating the drum, supplying hot air to the tub, and supplying steam to the tub.

The control command may further include supplying or discharging water to or from the tub.

The releasing may be performed only when a temperature inside the tub, sensed when the control command is completely performed, is below a reference temperature.

The releasing may be performed only when a level of water inside the tub, sensed when the control command is completely performed, is below a reference water level.

When it is sensed in the sensing that at least a portion of the drawer is discharged, the method may stand by until it is sensed that the drawer is completely inserted.

The laundry treatment apparatus may further include a display unit configured to display or perform notification of a state of the laundry treatment apparatus, and the control method may further include performing first notification of displaying, on the display unit, that the drawer is discharged.

The laundry treatment apparatus may further include an input unit configured to receive a signal corresponding to separation of the drawer from the cabinet, and the control method may further include determining whether or not a locking release condition under which the drawer is separable from the cabinet is satisfied by controlling the fastening unit when the signal is input via the input unit before the control command is completely performed.

The locking release condition may include a state in which the drum stops.

The locking release condition may include a state in which a temperature inside the tub is below a reference temperature.

The locking release condition may include a state in which a level of water inside the tub is below a reference water level.

The locking release condition may include a state in which supply of hot air or steam to the tub stops.

The laundry treatment apparatus may further include a display unit configured to display or perform notification of a state of the laundry treatment apparatus, and the control method may further include performing second notification of displaying that discharge of the drawer is rejected by controlling the display unit when the locked state is maintained because it is determined in the determining that the locking release condition is not satisfied.

The control method may further include determining whether or not the signal is additionally input via the input unit within a predetermined time when the locked state is maintained because it is determined in the determining that the locking release condition is not satisfied.

The control method may further include satisfying the locking release condition when the signal is additionally input via the input unit in the determining whether or not the signal is additionally input.

The satisfying may include at least one of stopping rotation of the drum and stopping the supply of hot air or steam to the tub.

The satisfying may include at least one of standing by until the temperature inside the tub is less than the reference temperature, operating a blowing fan, and supplying cold water.

The satisfying may include discharging water so that the level of water inside the tub is less than the reference water level.

The control method may further include temporarily releasing the locked state in which the drawer is fixed to the cabinet by controlling the fastening unit when the satisfying is completed.

The control method may further include again locking the drawer to the cabinet by controlling the fastening unit when the sensing unit senses that the drawer is discharged from the cabinet and thereafter is again inserted into the cabinet.

The control method may further include again locking the drawer to the cabinet by controlling the fastening unit when the sensing unit does not sense that the drawer is discharged from the cabinet for a predetermined time.

The performing the control command may be again executed when the again locking is performed.

The laundry treatment apparatus may further include an introduction aperture formed in an upper surface of the tub and located under a through-hole in the drawer, and a door provided on one of the drawer and the tub to open or close the introduction aperture, and the sensing unit senses whether or not the door opens the introduction aperture, and the control method may further include sensing whether or not the door opens the introduction aperture via the sensing unit before the performing the control command is completed.

The laundry treatment apparatus may further include a display unit configured to display or perform notification of a state of the laundry treatment apparatus, and the control method may further include performing third notification of displaying a user that the door is opened by controlling the display unit when the sensing unit senses that the door opens the introduction aperture in the sensing.

The control method may further include satisfying a locking release condition so as to permit the drawer to be separated from the cabinet when the sensing unit senses that the door opens the introduction aperture in the sensing.

The locking release condition may include at least one of a state in which the drum stops, a state in which a temperature inside the tub is below a reference temperature, and a state in which a level of water inside the tub is below a reference water level, and the satisfying may include at least one of stopping rotation of the drum and stopping the supply of hot air or steam to the tub, standing by until the temperature inside the tub is less than the reference temperature, operating a blowing fan, supplying cold water, and discharging water so that the level of water inside the tub is less than the reference water level.

The control method may further include temporarily releasing the locked state in which the drawer is fixed to the cabinet by controlling the fastening unit when the satisfying is completed.

After the temporarily releasing, the sensing unit may be controlled so as to sense whether or not the drawer is discharged from the cabinet and thereafter is again inserted into the cabinet.

The control method may further include sensing whether or not the door closes the introduction aperture by controlling the sensing unit when the sensing unit senses that the drawer is discharged and thereafter is again inserted.

The control method may further include again locking the drawer to the cabinet by controlling the fastening unit when it is sensed in the sensing that the door closes the introduction aperture.

The performing third notification may be repeated when it is sensed that the door opens the introduction aperture in the sensing.

It is to be understood that both the foregoing general description and the following detailed description of the present invention are exemplary and explanatory and are intended to provide further explanation of the present invention as claimed.

BRIEF DESCRIPTION OF THE DRAWINGS

The accompanying drawings, which are included to provide a further understanding of the present invention and are incorporated in and constitute a part of this application, illustrate embodiment(s) of the present invention and together with the description serve to explain the principle of the present invention. In the drawings:

FIGS. 1 to 3 illustrate the basic structure of a laundry treatment apparatus according to the present invention;

FIG. 4 illustrates the structure of a water-level sensor unit in the laundry treatment apparatus of the present invention;

FIG. 5 illustrates one embodiment of a fastening unit in the laundry treatment apparatus of the present invention;

FIG. 6 illustrates another embodiment of the fastening unit in the laundry treatment apparatus of the present invention;

FIGS. 7 and 8 illustrate a further embodiment of the fastening unit in the laundry treatment apparatus of the present invention;

FIG. 9 illustrates a sensing unit in the laundry treatment apparatus of the present invention;

FIG. 10 illustrates the structure of a controller for controlling the laundry treatment apparatus of the present invention;

FIG. 11 illustrates a method of controlling the locking and locking-release of a drawer using the components of the laundry treatment apparatus of the present invention; and FIG. 12 illustrates a control method that prevents an accident when a door is opened during the operation of the laundry treatment apparatus using the components of the laundry treatment apparatus of the present invention.

DETAILED DESCRIPTION OF THE INVENTION

Hereinafter, exemplary embodiments of the present invention will be described in detail with reference to the accompanying drawings. Meanwhile, the configuration of an apparatus or a control method of the apparatus, which will be described below, is merely given to describe the embodiments of the present invention, without being intended to limit the scope of the present invention. The same reference numerals used throughout the specification refer to the same constituent elements.

As illustrated in FIGS. 1 and 2, a laundry treatment apparatus 100 of the present invention, designated by reference numeral 100, includes a cabinet 2, a drawer 3 provided so as to be discharged from the cabinet 2, a tub 4 provided inside the drawer 3 for storing water therein, and a drum 5 rotatably provided inside the tub 4 for storing laundry therein.

The laundry treatment apparatus of the present invention, illustrated in FIGS. 1 and 2, is merely given to explain the structure of a drawer-type washing machine, and is not limited to the configuration.

The laundry treatment apparatus of the present invention may have any other external and internal structures so long as the drawer 3 may be discharged from the cabinet 2.

The following detailed structure relates to an embodiment for the brief description of the laundry treatment apparatus of the present invention, and is not limited to components described below.

The cabinet 2 may serve to define the external appearance of the laundry treatment apparatus, or may merely provide the space in which the drawer 3 is accommodated. In any case, the cabinet 2 may be provided in the front surface thereof with an opening 21, through which the drawer 3 is inserted.

The drawer 3 may include a drawer body 31, which is inserted into the cabinet 2 through the opening 21, a drawer panel 33, which is fixed to the front surface of the drawer body 31 so as to open or close the opening 21, and a drawer cover 35, which defines the upper surface of the drawer body 31.

The drawer panel 33 may also serve as a handle, which is used to discharge the drawer body 31 from the cabinet 2, because the drawer panel 33 is fixed to the front surface of the drawer body 31.

The drawer panel 33 may be provided with a display unit 331, via which a control command associated with the operation of the laundry treatment apparatus 100 is input or a message associated with the operation and state of the laundry treatment apparatus 100, is displayed to a user. The display unit 331 may be provided as a display panel that displays a screen, and may further include a speaker (not illustrated), which generates a warning sound, an alarm sound or the like. In addition, the display unit 331 may serve as a control panel that is capable of being touched by the user so as to operate the laundry treatment apparatus.

In addition, the drawer panel 33 may be provided with a pause button 520, which pauses the driving (e.g. drum rotation, steam supply, water supply or drainage) of the laundry treatment apparatus, and a locking-release button 530, which receives information about the user's intention to arbitrarily release the locking of the drawer 3, which will be described later.

The pause button 520 and the locking-release button 530 are conceivable as means that senses the user's intention to discharge the drawer 3 from the cabinet 2, and thus may be collectively referred to as an input unit 500.

Here, as illustrated, the pause button 520 and the locking-release button 530 may be provided on the drawer panel 33, but may be provided anywhere so long as the user can touch the button to input a command.

The drawer body 31 may have any shape so long as it may be inserted into the cabinet 2 through the opening 21 and may provide the space in which the tub 4 is accommodated. FIG. 1 illustrates the drawer body 31 having an empty hexahedral shape by way of example.

As illustrated in FIG. 2, the tub 4 includes a tub body 41, which is located inside the drawer body 31 to store water therein, and a tub cover 43, which defines the upper surface of the tub body 41. The tub body 41 may take the form of a cylinder having an open upper surface, and a heater 411 may be provided inside the tub body 41 to heat water. In addition to heating water, the heater 411 may generate steam and supply the steam into the tub body 41.

The tub cover 43 may have an introduction aperture 431, which communicates the inside of the tub body 41 with the outside of the tub body 41, and a supply aperture 433 through which water is introduced into the tub body 41.

The drawer cover 35 may have a first through-hole 351 and a second through-hole 353, which communicate the inside of the drawer body 31 with the outside. The first through-hole 351 may be provided for the introduction and discharge of laundry, and the second through-hole 353 may be provided to supply water required for the washing of laundry.

The introduction aperture 431 may be provided under the first through-hole 351 in the drawer cover 35, and the supply aperture 433 may be provided under the second through-hole 353 in the drawer cover 35.

The introduction aperture 431 serves to allow laundry to be introduced into the tub body 41, or to allow the laundry inside the tub body 41 to be discharged to the outside of the tub body 41. The introduction aperture 431 may be opened or closed by a door 45.

The tub 4 having the above-described structure is coupled to the drawer body 31 via a tub support unit 6. The tub support unit 6 may include may include a first support member 61 provided on the drawer body 31, a second support member 63 provided on the tub body 41, and a connector 65, which interconnects the first support member 61 and the second support member 63.

The connector 65 may include a first connection piece 651 seated in the first support member 61, a second connection piece 653 configured to support the second support member 63, and a bar 655, which interconnects the first connection piece 651 and the second connection piece 653.

The first connection piece 651 may be shaped so as to be movable in the first support member 61 while being seated in the first support member 61. The second connection piece 653 may be shaped so as to support the second support member 63 and to be movable in the second support member 63.

The bar 655 may be provided so as to form a right angle with respect to the bottom surface of the cabinet 2 (i.e. provided parallel to the height direction Z of the cabinet 2 so as to form a right angle with respect to the bottom surface of the drawer 3).

In the present invention, at least three tub support units 6 are provided to couple the tub body 41 to the drawer body 31 and the bar 655 is provided so as to form a right angle with respect to the bottom surface of the drawer body 31. Therefore, the distance between the tub cover 43 and the drawer cover 35 may be increased, compared to the case where the bar 655 is tilted by a predetermined angle relative to the Z-axis.

Thus, the tub support unit 6 provided in the present invention may reduce the possibility of the tub cover 43 colliding with the drawer cover 35 even if the tub body 41 vibrates inside the drawer body 31.

Meanwhile, when the bar 655 is provided so as to form a right angle with respect to the bottom surface of the drawer body 31, at least one of the first support member 61 and the second support member 63 may be separably coupled to the drawer body 31.

When at least three tub support units 6 are provided and both the first support member 61 and the second support member 63 are not separable from the drawer body 31, a worker who attempts to fix the tub body 41 to the drawer body 31 first needs to insert the tub body 41 into the drawer body 31 so as to prevent the second support member 63 from interfering with the first support member 61, and thereafter needs to rotate the tub body 41 so that the second support member 63 is located on the vertical axis that passes through the first support member 61, in order to couple the first connection piece 651 to the first support member 61.

The feature by which the bar 655 of the tub support unit 6 forms a right angle with respect to the bottom surface of the drawer 3 serves to minimize the distance S between the outer circumferential surface of the tub body 41 and the inner circumferential surface of the drawer body 31 so as to minimize the volume of the laundry treatment apparatus 100, but may deteriorate the strength of assembly of the first connection piece 651 and the first support member 61 described above. This problem may be solved by making the first support member 61 be separable from the drawer body 31.

The drum 5, which is provided inside the tub 4, may include a cylindrical drum body 51 having an opening 53 formed in the upper surface thereof. The opening 53 is located under the introduction aperture 431, and therefore, the laundry supplied through the introduction aperture 431 may be supplied to the drum body 51 through the opening 53.

Meanwhile, a plurality of drum through-holes 59 may be provided in a bottom surface 57 and a circumferential surface 55 of the drum body 51 to communicate the inside of the drum body 51 with the tub body 41.

The drum body 51 may be rotated inside the tub body 41 by a drive unit M. The drive unit M may include a stator M1, which is located outside the tub body 41 and is fixed to the bottom surface of the tub body 41, a rotor M2, which is configured to be rotated by a rotating magnetic field provided by the stator M1, and a rotating shaft M3, which penetrates the bottom surface of the tub body 41 to interconnect the bottom surface 57 of the drum 5 and the rotor M2. In this case, the rotating shaft M3 may be provided so as to form a right angle with respect to the bottom surface of the tub body 41.

The laundry treatment apparatus 100 having the structure described above supplies water to the tub 4 via a water supply unit 7, and discharges the water stored in the tub 4 to the outside of the cabinet 2 via a drain unit 8.

As exemplarily illustrated in FIG. 2, the water supply unit 7 may include a first water supply pipe 71 connected to the supply aperture 433 formed in the tub cover 43, a second water supply pipe 73 connected to a water supply source, which is located at the outside of the cabinet 2, and a connection pipe 75 fixed to the tub cover 43 to interconnect the first water supply pipe 71 and the second water supply pipe 73.

The first water supply pipe 71 may interconnect the supply aperture 433 and the connection pipe 75 through the second through-hole 353 provided in the drawer cover 35. The first water supply pipe 71 may be a corrugated pipe in order to prevent the first water supply pipe 71 from being separated from the connection pipe 75 when the tub 4 vibrates (see FIG. 3).

The second water supply pipe 73 may also be a corrugated pipe in order to prevent the second water supply pipe 73 from being separated from the connection pipe 75 when the drawer 3 is discharged from the cabinet 2. The second water supply pipe 73 may be opened or closed by a water supply valve 77, which is controlled by a controller (not illustrated).

Alternatively, unlike the illustration of FIG. 2, the water supply unit 7 may include a single water supply pipe, which interconnects a water supply source (not illustrated) located outside the cabinet 2 and the supply aperture 433 provided in the tub cover 43. In this case, the water supply pipe may be a corrugated pipe.

The drain unit 8 may include a drain pump 81 fixed to the drawer body 31, a first drain pipe 83 configured to guide water inside the tub body 41 to the drain pump 81, and a second drain pipe 85 configured to guide water discharged from the drain pump 81 to the outside of the cabinet 2. In this case, the second drain pipe 85 may be a corrugated pipe.

In the laundry treatment apparatus 100 having the structure described above, after laundry is introduced into the drum 5 and water and detergent are supplied to the tub 4, the laundry is washed as the drum 5 is rotated via the drive unit M.

Meanwhile, the laundry treatment apparatus 100 of the present invention having the above-described structure may further include a hot-air supply unit 10, which supplies hot air into the tub 4 or the drum 5. That is, the hot-air supply unit 10 may be provided separately from the heater 411 and may supply hot air to the tub 4 or the drum 5. The hot-air supply unit 10 may receive water supplied from the water supply unit 7 and may heat the water so as to supply the heated water into the tub 4 or the drum 5. In addition, the hot-air supply unit 10 may include a hot air heater 11, which heats water therein to generate steam, and a blowing fan 12, which supplies hot air to the tub 4 or the drum 5.

It is to be noted that the hot-air supply unit 10 may have a circulation structure so long as it can supply hot air into the drum 5.

In addition, a temperature sensor 700 may be provided inside the tub 4 to measure the temperature of water or air stored in the tub 4. The temperature sensor 700 may be provided near the heater 411 so as to immediately check the temperature of the heater 411. The temperature sensor 700 may be a thermistor (NTC, PTC or CTR), a thermo-sensitive ferrite, or a metallic temperature gauge.

It is to be noted that the temperature sensor 700 may be provided at any position and may have any other configuration so long as it can measure the temperature inside the tub 4 or the drum 5.

As illustrated in FIG. 3, the door 45 may include a frame 451 rotatably coupled to the tub cover 43 via a hinge 453, a window 455 provided in the frame 451, and a door handle 457 configured to separably couple the frame 451 to the tub cover 43.

The window 455 may be formed of a transparent material to allow the user to view the inside of the tub body 41 when the drawer 3 is discharged from the cabinet 2.

Meanwhile, in order to prevent the water inside the tub body 41 from being discharged to the outside of the tub body 41 through the introduction aperture 431, any one of the frame 451 and the tub cover 43 may be provided with a sealing unit 459, which hermetically seals the space between the frame 451 and the introduction aperture 431 when the door 45 closes the introduction aperture 431.

As illustrated in FIG. 4, a water-level sensor unit 600 may be provided to the lower portion of the tub 4 to sense the level of wash water stored in the tub 4.

The water-level sensor unit 600 includes a branch pipe 610, which diverges upward from the first drain pipe 83 and is connected to the drain unit 8, and a pressure water-level sensor (not illustrated, for example, a diaphragm pressure sensor), which is connected to the branch pipe 610 to sense the level of wash water stored in the tub 4.

In addition, an air chamber 620 is provided between the branch pipe 610 and the pressure water-level sensor. The air chamber 620 may allow the pressure water-level sensor to easily detect a change in pressure in the branch pipe 610 based on the volume thereof.

The laundry treatment apparatus 100 may include a controller (not illustrated), which may sense the level of wash water stored in the tub 4 by measuring the result value of the pressure water-level sensor.

It is to be noted that although the water-level sensor unit 600 is illustrated as including the branch pipe 610, the air chamber 620, and the pressure water-level sensor, this is merely given for description, and any other sensor may be provided so long as it can sense the level of wash water stored in the tub 4.

In addition, although not illustrated, the laundry treatment apparatus 100 may further include a temperature sensor, which may sense the temperature inside the tub 4 or the drum 5.

Meanwhile, in the laundry treatment apparatus according to the embodiment of the present invention, when vibration of the drum 5 or the tub 4 caused by the operation of the drive unit M is transmitted to the drawer 3, noise or vibration may be generated due to a collision between the drawer 3 and the cabinet 2. In addition, when vibration caused by the rotation of the drum 5 is transmitted to the drawer 3, there is the possibility of the drawer 3 being discharged from the cabinet 2.

In addition, in the case where water is stored in the tub 4 beyond a reference water level, when the drawer 3 is discharged, the center of weight may move to the drawer 3 by the weight of the tub 4 and the weight of laundry and water stored in the tub 4, which may cause the cabinet 2 to be turned over. Even if the cabinet 2 is not turned over, there is the risk of the water stored in the tub 4 leaking to the outside of the drawer 3.

Here, the reference water level may be set to the water level at which the cabinet 2 begins to turn over when the drawer 3 is discharged, or may be set to the water level at which water leaks outward from the tub 4 when the drum 5 is rotated. For example, the reference water level may be set to the water level that corresponds to half the height of the drum 5.

In addition, in the case where steam or hot water is supplied to the tub 4 via a steam supply unit (not illustrated) and the heater 411, the user may suffer burns when the drawer 3 is discharged from the cabinet 2. Moreover, even if the supply of steam or the supply of hot water to the tub 4 has been completed, when the temperature inside the tub 4 is a reference temperature or more, the user may suffer burns when the drawer 3 is discharged from the cabinet 2. Here, the reference temperature may be set to the temperature at which the user begins to perceive burns or heat. For example, the reference temperature may be set to 45 degrees Celsius.

To solve the problem described above, the laundry treatment apparatus 100 according to the embodiment of the present invention may further include a fastening unit 300, which may fix the drawer 3 to the cabinet 2 to realize locking in response to a control signal generated in the controller.

The fastening unit 300 may prevent the drawer 3 from being unintentionally discharged from the cabinet 2 and may also minimize vibration of the drawer 3 inside the cabinet 2.

FIG. 5 illustrates an embodiment of the fastening unit 300, which may be applied to the laundry treatment apparatus 100 according to the embodiment of the present invention. The fastening unit 300 may be configured as a grip-type fastening unit 310.

As illustrated in FIG. 5, the drawer 3 may include a grip 311, which enables easy discharge of the drawer 3, and an extension 312, which extends from the grip 311 toward the cabinet 2.

A drawer switch 313 may be provided inside the cabinet 2. The drawer switch 313 may be provided therein with an electrical device, for example, a solenoid for sensing whether the drawer 3 is opened or closed so as to prevent the drawer 3 from being opened during washing.

In addition, the drawer 3 is provided with a holder 314 at the position that corresponds to the installation position of the drawer switch 313. The holder 314 is assembled to a bracket 315 so as to be connected to the drawer switch 313 at one side of the drawer 3.

The holder 314 is connected to a lever 316, which is located inside the grip 311 and is manipulated by the user, and to a torsion spring 317, which elastically supports the lever 316 so as to keep the lever 316 at the original position thereof.

That is, the holder 314 may be connected to the lever 316 and may move along with the lever 316 so as to be brought into contact with or not brought into contact with the drawer switch 313.

The torsion spring 317 is provided inside the grip 311 so that one end thereof elastically supports the lever 315 and the other end thereof is caught by the extension 312. The extension 312 may be integrally formed with a frame structure, which configures the grip 311, separately from the bracket 315 to which the lever 316 and the holder 314 are installed.

The locked state of the drawer 3, maintained by the drawer fastening unit 300 configured as described above, may be released as the holder 314 is separated from the drawer switch 313 by the lever 316 when the user pulls the lever 316.

However, while the laundry treatment apparatus is in operation, the drawer switch 313 electrically locks the holder 314 to prevent the holder 314 from being separated therefrom. That is, the lever 316 is not pulled.

When the lever 316 is pulled in the state in which the laundry treatment apparatus is not in operation, the holder 314 is released from the drawer switch 313 while applying torsion to the torsion spring 317, thereby enabling the drawer 3 to be opened.

Thereafter, when the user manipulation force is no longer applied to the lever 316, the lever 316 and the holder 314 may be returned to the original positions thereof by the torsion spring 317.

At this time, when the drawer 3 is closed, the holder 314 may be brought into contact with the drawer switch 313 by the elastic force of the torsion spring 317.

Meanwhile, the user may attempt to discharge the drawer 3 while washing or drying is in progress. In this case, the controller (not illustrated) provided in the laundry treatment apparatus may notify the user that washing is in progress via the display unit 331. The display unit 331 may generate a warning sound, or may turn on an LED blinker.

Then, in the state in which the operation of the drum 5 is stopped by the controller after a certain time passes, the holder 314 may be released from the drawer switch 313 so as not to come into contact with the drawer switch 313. In addition, the controller may cause the display unit 331 to display the time at which the discharge of the drawer 3 will be permitted after the operation of the drum 5 stops.

Meanwhile, the user may input the user's intention to discharge the drawer 3 to, for example, the controller in the locked state of the drawer 3. That is, the laundry treatment apparatus 100 may include the input unit 500, which receives a signal corresponding to the user's intention to separate the drawer 3 from the cabinet 2.

The input unit 500 may be the pause button 520, or may be the locking-release button 530. Alternatively, when the user applies force to discharge the drawer 3, a load sensor 510 may detect the user's intention to discharge the drawer 3 by sensing the applied force.

That is, it can be said that the input unit 500 includes at least one of the pause button 520, the locking-release button 530, and the load sensor 510.

The load sensor 510 may be attached to the lever 316. When the user grips the lever 316 and applies force thereto in order to discharge the drawer 3, the load sensor 510 may sense the force and the controller may compare the sensed result with a reference value. When the sensed result is the reference value or more, the controller may determine that the user has the intention to discharge the drawer 3. That is, the load sensor 510 described above may transmit a signal, which is sensed when the user pulls the drawer 3 in order to discharge the drawer 3, to the controller.

Hereinafter, another embodiment of the fastening unit 300 in the laundry treatment apparatus 100 of the present invention will be described with reference to FIG. 6. The laundry treatment apparatus 100 according to the embodiment of the present invention may include a solenoid-type fastening unit 320. That is, the solenoid-type fastening unit 320 according to the present invention fixes the drawer 3 to the cabinet 2 based on a signal provided by a controller, unlike the fastening unit 300 having the grip 311, with which the user separates the drawer 3 from the cabinet 2 by applying force thereto.

FIG. 6 illustrates the configuration of the solenoid-type fastening unit 320.

As illustrated in FIG. 6, the solenoid-type fastening unit 320 (hereinafter referred to as "fastening unit") may include a first fastener 321 provided on the cabinet 2 and a second fastener 322 provided on the drawer 3 so as to be coupled to the first fastener 321 in response to a control signal of a controller.

The second fastener 322 may include a body 322*a* fixed to the drawer 3, a plunger 322*b* provided to protrude from the body 322*a* so as to be coupled to the first fastener 321, an elastic support member 322*c* configured to push the plunger 322*b* so that the plunger 322*b* protrudes from the body 322*a*, and a coil 322*d* configured to move the plunger 322*b* into the body 322*a* depending on whether or not current is supplied thereto. The coil 322*d* receives current via a switch 322*e*, which is controlled by a controller 37.

The controller 37 may control the switch 322*e* so that no current is supplied to the coil 322*d* (i.e. so that the second fastener remains in the state in which it is coupled to the first fastener) when the drive unit M is in operation, and may control the switch 322*e* so that current is supplied to the coil 322*d* (i.e. so that the second fastener remains in the state in which it is not coupled to the first fastener) when the drive unit M is not in operation.

Meanwhile, the second fastener 322 described above may be fixed to the drawer body 31 so as to be exposed outward when the drawer panel 33 is separated from the drawer body 31.

As described above, the drawer panel 33 serves to open or close the opening 21 of the cabinet 2 and to assist the user in discharging the drawer body 31 from the cabinet 2. Therefore, the drawer panel 33 is exposed to the outside of the cabinet 2 so as to form one surface of the cabinet 2 in which the opening 21 is formed.

Thus, in the case where the second fastener 322 is provided so as to be exposed to the outside of the cabinet 2 when the drawer panel 33 is separated from the drawer body 31, the repair or inspection of the second fastener 322 may be conveniently performed without separating the drawer cover 35.

In one example, the first fastener 321 may include a support body 321*a* fixed to the cabinet 2 and a fastening hole 321*b*, which is formed in the support body 321*a* so that the plunger 322*b* is inserted thereinto.

Here, it is to be noted that the first fastener 321 may have any shape so long as it allows the plunger 322*b* to be coupled thereto, and therefore, the first fastener 321 may include the support body 321*a* and a fastening recess formed in the surface of the support body 321*a*.

Moreover, the structure of the first fastener 321 is not necessarily limited to the illustration of FIG. 6. That is, the first fastener 321 may take the form of a fastening hole or a fastening recess, which is provided in the inner circumferential surface of the cabinet 2 so that the plunger 322*b* is inserted thereinto. In this case, the support body 321*a* of the first fastener may be omitted.

Meanwhile, as described above, the laundry treatment apparatus 100 according to the embodiment of the present invention is configured such that the door 45, through which laundry is supplied into the drum 5, is provided on the upper surface of the tub 4 and the drive unit M, which rotates the drum 5, is provided on the bottom surface of the tub 4.

Because the rotating shaft M3, which rotates the drum 5, penetrates the bottom surface of the tub 4 and is connected to the bottom surface of the drum 5, the amplitude of vibration of the drum 3 (i.e. change in distance between the outer circumferential surface of the drum and the inner circumferential surface of the tub), which is a major source of vibration of the laundry treatment apparatus 100, may increase in the direction from the bottom to the top of the drum 5.

In consideration of the fact that the laundry treatment apparatus 100 of the present invention is configured such that the amplitude of vibration increases in the direction from the bottom to the top of the drum 5, when the fastening unit 320 is provided at a position higher than the drive unit M, the phenomenon in which the drawer 3 vibrates inside the cabinet 2 or the phenomenon in which the drawer 3 is discharged from the cabinet 2 may be more effectively prevented. Thus, the fastening unit 320 may be provided at a position higher than the drive unit M on the basis of the bottom surface of the drawer 3.

The fastening unit 320 may be provided on the rear surface of the drawer 3 so as to fix the upper surface of the drawer 3 to the upper surface of the cabinet 2, or may be provided so as to connect opposite side surfaces of the drawer 3 to opposite side surfaces of the cabinet 2 respectively, as illustrated in FIG. 6.

In the former case, the first fastener 321 may be provided on the inner ceiling portion of the cabinet 2, and the second fastener 322 may be provided on the drawer cover 35 (more particularly, the upper surface of the drawer).

In the latter case (see FIG. 6), the first fastener 321 may be provided on each of opposite sides of the inner circumferential surface of the cabinet 2, and the second fastener 322 may be provided on each of opposite side surfaces of the drawer 3.

As illustrated in FIG. 6, the tub support unit 6 provided in the laundry treatment apparatus 100 serves to connect the outer circumferential surface of the tub 4 to the drawer 3. Therefore, when the drum 5 rotates, the tub 4 may vibrate in the plane that is parallel to the bottom surface of the drawer 3.

When the tub 4 vibrates in the plane that is parallel to the bottom surface of the drawer 3, the force applied to any one of the left side surface and the right side surface of the drawer 3 may differ from the force applied to the other side surface, depending on the form of vibration.

Here, when two first fasteners 321 are provided respectively on opposite sides of the inner circumferential surface of the cabinet 2 and two second fasteners 322 are provided respectively on opposite side surfaces of the drawer 3, it is possible to effectively prevent the drawer 3 from being discharged from the cabinet 2 when the tub 4 vibrates in the plane that is parallel to the bottom surface of the drawer 3.

Unlike the above description, although the first fastener 321 may be provided on the drawer 3 and the second fastener 322 may be provided on the cabinet 2, the second fastener 322 may be provided on the drawer 3 and the first fastener 321 may be provided on the cabinet 2 in consideration of the fact that the second fastener 322 is operated by the controller 37, which controls, for example, the drive unit M, the display unit 331, and the input unit 500.

Moreover, the second fastener 322 located on one side surface (the left side surface) of the drawer 3 and the second fastener 322 located on the other side surface (the right side surface) of the drawer 3 may be provided at different heights. However, even in this case, the respective second fasteners 322 may be provided higher than the drive unit M.

Meanwhile, the fastening unit 320 described above may be provided to couple the front side of the side surface of the drawer body 31 to the cabinet 2 as described above, rather than coupling the rear side of the drawer body 31 to the cabinet 2.

Meanwhile, most devices have an assembly tolerance, and the assembly tolerance increases as the structure of the device is more complicated. In the case of the laundry treatment apparatus 100 according to the embodiment of the present invention, the number of elements coupled to the rear side of the drawer body 31 is greater than the number of elements coupled to the front side of the drawer body 31. That is, because the drawer panel 31 is provided on the front side of the drawer body 31, but the water supply unit 7 and the drain unit 8 need to be provided on the rear side of the drawer body 31, there is a high possibility of the sum of assembly tolerances of the respective elements assembled to the rear side of the drawer body 31 being greater than the sum of assembly tolerances of the elements provided on the front side of the drawer body 31.

An increase in the sum of assembly tolerances may prevent coupling of two elements, which are provided so as to be selectively coupled to each other. Therefore, the fastening unit 320 according to the present invention may be located on the front side of the drawer 3, rather than on the rear side of the drawer 3. That is, the element 322 of the fastening unit 320 that is fixed to the drawer body 31 may be provided near an area of the space provided by the drawer body 31 in which the drawer panel 33 is fixed.

Hereinafter, a further embodiment of the fastening unit 300 will be described with reference to FIG. 8. The fastening unit 300 in the laundry treatment apparatus 100 of the present invention may be a bar-type fastening unit 330. FIG. 7 illustrates the bar-type fastening unit (hereinafter referred to as "fastening unit").

The fastening unit 330 includes separable fasteners 331 and 332, which is configured to reciprocate in any one direction of the height direction and the width direction of the drawer 3 so as to separably couple the drawer 3 to the cabinet 2, and a transporter 333, which is configured to reciprocate in the other direction of the height direction and the width direction of the drawer 3 so as to operate the fasteners 331 and 332.

Hereinafter, the case where the fasteners 331 and 332 reciprocate in the width direction X of the drawer 3 and the transporter 333 reciprocates in the height direction Y of the drawer 3 will first be described.

As illustrated in FIG. 7, the fasteners may include a first bar 331, which is separably coupled to one side surface of the cabinet 2, and a second bar 332, which is separably coupled to the other side surface of the cabinet 2.

The first bar 331 is connected to the transporter 333 via a first coupling portion 334, and a free end F1 of the first bar 331 is coupled to or separated from a first accommodating body 336 provided on the cabinet 2 depending on the position of the transporter 333.

The second bar 332 is connected to the transporter 333 via a second coupling portion 335, and a free end F2 of the second bar 332 is coupled to or separated from a second accommodating body 337 provided on the cabinet 2 depending on the position of the transporter 333.

To this end, the first accommodating body 336 may have an accommodating recess 336*a* capable of accommodating the free end F1 of the first bar 331, and the second accommodating body 337 may have an accommodating recess 337*a* capable of accommodating the free end F2 of the second bar 332.

Reciprocation of the first bar 331 may be guided by a first bar guide 338 provided on the drawer 3, and reciprocation of the second bar 332 may be guided by a second bar guide 339 provided on the drawer 3.

As illustrated in FIG. 8, the transporter 333 may include a transport body 333*a* configured to reciprocate in the height direction Y of the drawer 3, a first slot 333*b* provided in the transport body 333*a* for the connection of the first bar 331, and a second slot 333*c* provided in the transport body 951 for the connection of the second bar 332.

The drawer 3 may include a guide 99, which provides the movement path of the transport body 333*a*. FIG. 7 illustrates the case where the guide 99 is configured to support opposite side surfaces of the transport body 333*a* by way of example.

The first slot 333*b* may serve to push or pull the first coupling portion 334 of the first bar 331 (to move the first bar 331), and the first coupling portion 334 of the first bar 331 may be inserted into the first slot 333*b* to thereby be connected to the transport body 333*a*.

The first slot 333*b* may have a predetermined length in the height direction Y of the transport body 333*a* and may be inclined at a predetermined angle relative to the height direction Y of the transport body 333*a*.

This serves to separate the free end F1 of the first bar 331 from the first accommodating body 336 when the first coupling portion 334 is located on the upper end of the first slot 333*b* and to couple the free end F1 of the first bar 331 to the first accommodating body 336 when the first coupling portion 334 is located on the lower end of the first slot 333*b*.

The second slot 333*c* may serve to push or pull the second coupling portion 335 of the second bar 332 (to move the second bar 332), and the second coupling portion 335 of the second bar 332 may be inserted into the second slot 333*c* to thereby be connected to the transport body 333*a*.

The second slot 333*c* may have a predetermined length in the height direction Y of the transport body 333*a* (the reciprocating direction of the transport body 333*a*) and may be inclined at a predetermined angle relative to the height direction Y of the transport body 333*a*.

In this case, the distance between the upper end of the first slot 333*b* and the upper end of the second slot 333*c* may be less than the distance between the lower end of the first slot 333*b* and the lower end of the second slot 333*c*.

Thus, when the first coupling portion 334 and the second coupling portion 335 are located respectively on the upper ends of the first slot 333*b* and the second slot 333*c*, the free end F1 of the first bar 331 and the free end F2 of the second bar 332 may be separated respectively from the first accommodating body 336 and the second accommodating body 337. Then, when the first coupling portion 334 and the second coupling portion 335 are located respectively on the lower ends of the respective slots 333*b* and 333*c*, the free ends F1 and F2 of the respective bars 331 and 332 may be coupled respectively to the first accommodating body 336 and the second accommodating body 337.

The transporter 333 described above reciprocates in the height direction Y of the drawer 3 via a motor unit 97 provided on the drawer 3. The motor unit 97 may include a transport motor 971, which is fixed to the drawer 3, and a converter 975, which converts rotation power of the transport motor 971 into reciprocation power of the transport body 951.

The converter 975 may include a body 977, which is coupled to a rotating shaft 973 of the transport motor 971, a body slot 976, which is formed in the width direction X of the transport body 951, and a slot connecting portion 979, which interconnects the body 977 and the body slot 976.

The body 977 is rotated by the rotating shaft 973 of the transport motor 971, and the slot connecting portion 979 protrudes from the body 977. Therefore, when the transport motor 971 is operated, the slot connecting portion 979 may rotate along a circular path having a given diameter L2.

Meanwhile, the body slot 976 is formed in the direction X, which is orthogonal to the movement direction Y of the transport body 333*a*, and has a length L1, which is equal to or greater than the diameter L2 of the circular path defined by the slot connecting portion 979.

Thus, rotation of the rotating shaft 973 of the transport motor 971 may be converted into rectilinear reciprocation of the transport body 333*a* by the converter 975, and the transport body 333*a* may reciprocate in the height direction Y of the drawer 3 under the guidance of the guide 99.

Hereinafter, the operation of the fastening unit 330 having the above-described structure will be described with reference to FIGS. 7 and 8.

When the transport motor 971 is operated so that the body slot 976 is located lower than the rotating shaft 973 of the motor (i.e. the state in which the first coupling portion 334 is located on the upper end of the first slot 333*b* and the second coupling portion 335 is located on the upper end of the second slot 333*c*, as illustrated in FIG. 8), the first bar 331 and the second bar 332 may move respectively toward the transport body 333*a*. Therefore, the free end F1 of the first bar 331 remains in the state in which it is separated from the first accommodating body 336, and the free end F2 of the second bar 332 remains in the state in which it is separated from the second accommodating body 337.

When the free end F1 of the first bar 331 and the free end F2 of the second bar 332 are separated respectively from the respective accommodating bodies 336 and 337, the coupling between the drawer 3 and the cabinet 2 is released. Thus, the user may discharge the drawer 3 from the cabinet 2, or may insert the drawer 3 into the cabinet 2.

Meanwhile, when the rotating shaft 973 of the transport motor 971 is rotated by the controller (not illustrated), the transport body 333*a* moves upward in the height direction of the drawer 3 along the guide 99. When the body slot 976 is located higher than the rotating shaft 973 due to the upward movement of the transport body 333*a*, the first bar 331 and the second bar 332 move far away from each other.

That is, when the body slot 976 is shifted so as to be located higher than the rotating shaft 973, the free end F1 of the first bar 331 and the free end F2 of the second bar 332 move far away from the transport body 333*a* respectively (i.e. the first bar 331 and the second bar 332 move far away from each other).

When the free ends F1 and F2 of the respective bars move far away from the transport body 333*a*, the free end F1 of the first bar 331 is coupled to the first accommodating body 336 and the free end F2 of the second bar 332 is coupled to the second accommodating body 337, whereby the drawer 3 is fixed to the cabinet 2.

As described above, the laundry treatment apparatus 100 is configured such that the door 45, through which laundry is supplied, is provided on the upper surface of the tub 4 and the drive unit M, which rotates the drum 5, is provided on the bottom surface of the tub 4.

That is, because the rotating shaft M3, which rotates the drum 5, penetrates the bottom surface of the tub 4 and is connected to the bottom surface of the drum 5, the amplitude of vibration of the drum 5, which is a major vibration source of the laundry treatment apparatus, (variation in the distance between the outer circumferential surface of the drum 5 and the inner circumferential surface of the tub 4) may increase in a direction from the bottom to the top of the drum 5.

In consideration of the fact that the laundry treatment apparatus 100 of the present invention is configured such that the amplitude of vibration of the drum 5 increases from the bottom to the top, the first bar 331 and the second bar 332 of the fastening unit 330 may be located higher than the drive unit M (because this effectively prevents vibration of the drawer inside the cabinet or discharge of the drawer from the cabinet).

The tub support unit 6, which connects the outer circumferential surface of the tub 4 to the drawer 3, may vibrate in the plane that is parallel to the bottom surface of the drawer 3 during rotation of the drum 5.

When the tub 4 vibrates in the plane that is parallel to the bottom surface of the drawer 3, the force applied to any one of the left side surface and the right side surface of the drawer 3 may differ from the force applied to the other side surface, depending on the form of vibration.

However, because the fastening unit 330 according to the present invention includes the first bar 331, which fixes one side surface of the drawer 3 to the cabinet 2, and the second bar 332, which fixes the other side surface of the drawer 3 to the cabinet 2, it is possible to effectively prevent the drawer 3 from being discharged from the cabinet 2 when the tub 4 vibrates in the plane that is parallel to the bottom surface of the drawer 3.

Unlike the illustration of FIG. 8, the fastening unit 330 according to the present invention may be configured such that the first bar 331 reciprocates in the height direction of the drawer 3 to connect the upper surface of the drawer 3 to the top surface of the cabinet 2 and the second bar 332 reciprocates in the height direction of the drawer 3 to connect the lower surface of the drawer 3 to the bottom surface of the cabinet 2. In this case, the transport body 333*a* may be provided so as to reciprocate in the width direction of the drawer 3.

Moreover, the first bar 331 may be provided so as to reciprocate in the height direction of the drawer 3 and the second bar 332 may be provided so as to reciprocate in the height direction of the drawer 3. In this case, the first bar 331 may be connected to the transport body 333*a* via the first slot 333*b*, and the second bar 332 may be fixed to the upper end of the transport body 333*a*.

In addition, the fastening unit of the present invention may further include a third bar (not illustrated), which is moved along with the transport body 333*a*. In this case, the third bar may be provided so as to reciprocate in the height direction of the drawer 3, thereby separably coupling the upper surface of the drawer 3 to the top surface of the cabinet 2.

Meanwhile, the fastening unit 330 described above may be fixed to the drawer body 31 so as to be exposed outward when the drawer panel 33 is separated from the drawer body 31.

As described above, the drawer panel 33 serves to open or close the opening 21 of the cabinet 2 and to assist the user in discharging the drawer body 31 from the cabinet 2. Therefore, the drawer panel 33 is exposed to the outside of the cabinet 2 so as to form one surface of the cabinet 2 in which the opening 21 is formed.

Thus, in the case where the fasteners 331 and 332, the transporter 333, the motor unit 97 and the guide 99 are provided so as to be exposed to the outside of the cabinet 2 when the drawer panel 33 is separated from the drawer body 31, the repair or inspection of the fastening unit 330 may be conveniently performed.

Moreover, the fastening unit 330 described above may be located at the front side of the drawer body 31, rather than being located at the rear side of the drawer body 31.

Most devices require an assembly tolerance, and the assembly tolerance increases as the structure of the device is more complicated. In the case of the laundry treatment apparatus 100 according to the embodiment of the present invention, the number of elements coupled to the rear side of the drawer body 31 is greater than the number of elements coupled to the front side of the drawer body 31.

That is, because the drawer panel 31 is provided on the front side of the drawer body 31, but the water supply unit 7 and the drain unit 8 need to be provided on the rear side of the drawer body 31, there is a high possibility of the sum of assembly tolerances of the respective elements assembled to the rear side of the drawer body 31 being greater than the sum of assembly tolerances of the elements provided on the front side of the drawer body 31.

An increase in the sum of assembly tolerances may prevent coupling of two elements, which are provided so as to be selectively coupled to each other. Therefore, the fastening unit 330 according to the present invention may be located on the front side of the drawer 3, other than the rear side of the drawer 3.

Meanwhile, in the laundry treatment apparatus 100 of the present invention, the controller needs to determine whether the drawer 3 is completely inserted into the cabinet 2 or whether the drawer 3 is discharged from the cabinet 2. In the state in which the drawer 3 is not completely inserted into the cabinet 2, the controller may not control the fastening unit 300 so as to fix the drawer 3 to the cabinet 2. In addition, when the laundry treatment apparatus operates (performs rotation of the drum, the supply and discharge of water, the supply of steam, or the like) in this state, accidents may occur.

In addition, when the drawer 3 is discharged from the cabinet 2 during operation of the laundry treatment apparatus 100, the controller (not illustrated) may detect the discharge of the drawer 3, thereby allowing the user to take measures to prevent an accident.

To this end, the laundry treatment apparatus 100 of the present invention may further include a sensing unit 400, which may allow the controller (not illustrated) to determine whether or not the drawer 3 is discharged from the cabinet 2.

FIG. 9 illustrates an embodiment of the sensing unit 400 provided in the laundry treatment apparatus 100 of the present invention.

The sensing unit 400 may include a sensing-unit base 421, which is provided on the upper surface of the cabinet 2 in which the opening 21 is formed, a first magnetic-force detector 421*a*, which is provided on the front lower portion of the sensing-unit base 421 to sense a magnetic force signal, and a first magnetic-force generator 422*a*, which is provided on the drawer cover 35 at a position corresponding to the first magnetic-force detector 421*a* to generate magnetic force.

The first magnetic-force generator 422*a* may be formed of a material that emits magnetic force, such as a permanent magnet, and the first magnetic-force detector 421*a* may detect the position of the first magnetic-force generator 422*a* by detecting the strength of magnetic force from the first magnetic-force generator 422*a*.

As such, when the magnitude of magnetic force of the first magnetic-force generator 422*a* detected by the first magnetic-force detector 421*a* is a preset reference magnetic force (first reference magnetic force) or more, the controller (not illustrated) may recognize the current state as the state in which the drawer 3 is located inside the cabinet 2.

On the other hand, when the magnitude of magnetic force of the first magnetic-force generator 422*a* detected by the first magnetic-force detector 421*a* is below the first reference magnetic force, the controller (not illustrated) may recognize the current state as the state in which the drawer 3 is discharged from the cabinet 2.

Meanwhile, in order to detect a more accurate position of the drawer 3 and to detect whether the door 45 is opened or closed, the sensing unit 400 may further include a second magnetic-force generator 422*b* provided on the upper portion of the door frame 451, and a second magnetic-force detector 421*b* provided on the sensing-unit base 421 at a position corresponding to the second magnetic-force generator 422*b*.

As such, when the magnitude of magnetic force of the second magnetic-force generator 422*b* detected by the second magnetic-force detector 421*b* is a preset reference magnetic force (second reference magnetic force) or more, the controller (not illustrated) may recognize the current state as the state in which the drawer 3 is located inside the cabinet 2.

On the other hand, when the magnitude of magnetic force of the second magnetic-force generator 422*b* detected by the second magnetic-force detector 421*b* is below the second reference magnetic force, the controller (not illustrated) may recognize the current state as the state in which the drawer 3 is discharged from the cabinet 2.

That is, the sensing unit 400 may accurately detect whether or not the drawer 3 is discharged from the cabinet 2 using the second magnetic-force generator 421*b* and the second magnetic-force detector 422*b*, which are additionally provided therein.

In addition, because the second magnetic-force generator 421*b* is provided on the door frame 451, the controller (not illustrated) may recognize whether or not the door 45, which is located inside the cabinet 2, opens the introduction aperture 431.

That is, when the door 45 opens the introduction aperture 431 in the state in which the drawer 3 is completely inserted into the cabinet 2, the second magnetic-force generator 421*b* becomes remarkably close to the second magnetic-force detector 422*b*, and therefore, the controller may recognize that the door 45 has opened the introduction aperture 431.

Meanwhile, the sensing-unit base 421 may further include a wheel 421*c*, which may ensure the discharge of the drawer 3 from the cabinet 2 even when the door 45 opens the introduction aperture 431 in the state in which the drawer 3 is completely inserted into the cabinet 2.

The fastening unit 300, the sensing unit 400, and the input unit 500 provided in the laundry treatment apparatus 100 of the present invention described above are merely given as an embodiment to which the present invention may be applied, and may be replaced by any other structures so long as they may exert the functions of the fastening unit 300, the sensing unit 400, and the input unit 500. That is, a description related to the configuration of the laundry treatment apparatus 100 including the fastening unit 300, the sensing unit 400, and the input unit 500 is not intended to necessarily limit the present invention to the configuration, but is given to assist understanding, and any other configuration may be provided so long as it may exert the same function.

Hereinafter, the controller, which controls the laundry treatment apparatus 100 of the present invention, will be described with reference to FIG. 10.

The controller 37 of the laundry treatment apparatus 100 of the present invention may recognize the state of the inside of the tub 4 upon receiving signals from the temperature sensor 700 and the water-level sensor unit 600. In addition, the controller 37 may receive a washing course input signal about any one of washing, rinsing, drying and dehydration, and a combination thereof, from the display unit (or control panel) 331. In addition, the controller 37 may display the state of the laundry treatment apparatus 100 on the display unit 331 using sound or an image.

In addition, the controller 37 may determine whether or not the drawer 3 is completely inserted into the cabinet 2 via the sensing unit 400. That is, the controller 37 may control the sensing unit 400 so as to sense whether or not the drawer 3 is discharged from the cabinet 2.

In addition, the controller 37 may detect the user's intention to discharge the drawer 3 from the cabinet 2 via the input unit 500.

In addition, the controller 37 may control the drive unit M so as to rotate the drum 5 or to adjust the rotation speed thereof.

In addition, the controller 37 may control the heater 411 and the hot-air supply unit 10 so as to supply steam or hot air into the tub 4, or to heat the water supplied into the tub 4.

In addition, the controller 37 may control the fastening unit 300 so as to lock the drawer 3 so that the drawer 3 is fixed to the cabinet 2 without the risk of discharge, or to release the locking.

In addition, the controller 37 may control the water supply valve 77 and the drain pump 81 so as to supply water to the tub 4 or to discharge the water.

Meanwhile, the laundry treatment apparatus 100 of the present invention may perform at least one of a washing process of washing laundry, a rinsing process of rinsing laundry, a dehydration process of removing moisture from laundry, and a drying process of drying laundry to remove moisture, and may perform a specific washing course that combines the aforementioned processes.

When the laundry treatment apparatus 100 performs the washing process, the rinsing process, the dehydration process, the drying process or the like, the drum 5 may rotate, water may be supplied to or discharged from the tub 4, and steam or hot air may be supplied to the tub 4 or the drum 5. Here, when the laundry treatment apparatus rotates the drum 5, when the laundry treatment apparatus performs the supply or discharge of water to or from the tub 4, or when the laundry treatment apparatus supplies steam or hot air to the tub 4, the laundry treatment apparatus can be said to be operating.

When the drawer 3 is unintentionally discharged from the cabinet 2 or when the user arbitrarily discharges the drawer 3 from the cabinet 2 while the laundry treatment apparatus operates, various accidents may occur.

For example, when the drawer 3 is discharged from the cabinet 2 while the drum 5 rotates, the user's body may be exposed to and injured by the rotation of the drum 5, and, due to vibration of the drum 5, the drawer 3 may severely vibrate or the water stored in the tub 4 may leak outward.

In addition, when the drawer 3 is discharged from the cabinet 2 while water is supplied to or discharged from the tub 4, the water stored in the tub 4 may vibrate and leak outward, or the supply and discharge of water may not be smoothly performed due to a rapid change in the level of water.

In addition, when the drawer 3 is discharged from the cabinet 2 in the state in which water is supplied to the tub 4 beyond a reference water level, there is the risk of the cabinet 2 being turned over by the weight of the tub 4 and the water. Here, the reference water level may be defined as the level of water at which the cabinet 2 may be turned over when the drawer 3 is discharged from the cabinet 2. For example, the reference water level may be the water level that corresponds to half or more of the height of the drum 5 or at which the bottom surface of the drum 5 is immersed.

In addition, when the drawer 3 is discharged from the cabinet 2 in the state in which the temperature inside the tub 4 is a reference temperature or more, the user may be exposed to hot air and be burned. The reference temperature may be defined as the temperature at which the user is burned or suffers physical or mental damages. For example, the reference temperature may be about 45° C.

In addition, when the drawer 3 is discharged from the cabinet 2 in the state in which steam or hot air is supplied into the tub 4, the same result as that in the state in which the temperature inside the tub 4 is the reference temperature or more may occur.

As described above, when the laundry treatment apparatus 100 is operating or when a control command is given to begin the operation, it may be necessary to control the fastening unit 300 so as to lock the drawer 3 so as to be fixed to the cabinet 2 without the risk of discharge.

Meanwhile, when the operation of the laundry treatment apparatus 100 is completed, the fastening unit 300 may be controlled to separate the drawer 3 from the cabinet 2 so that the drawer 3 is dischargeable.

In addition, when discharge of the drawer 3 is required even if the laundry treatment apparatus 100 is operating, the fastening unit 300 may be controlled to release the locking of the drawer 3 as needed.

This is because, when the laundry treatment apparatus 100 unconditionally prevents the discharge of the drawer 3, the user's wishes may be disregarded, or the user may be incapable of flexibly responding to a specific situation in which additional laundry needs to be input or in which detergent or fabric softener needs to be input.

FIG. 11 illustrates a concrete control method, which may be applied to the laundry treatment apparatus 100 of the present invention in order to lock the drawer 3 to the cabinet 2 or to release the locking.

The control method of the laundry treatment apparatus 100 of the present invention may include an input step S1 of receiving, from the control panel 331, a control command to operate the laundry treatment apparatus 100.

The input step S1 may be defined as a step in which the controller receives a signal from the control panel 331 and issues a control command corresponding to the signal to each component of the laundry treatment apparatus 100.

That is, the control command of the controller 37 to operate the laundry treatment apparatus 100 may be a response to the user inputting a specific course for performing washing, rinsing, dehydration, drying or the like to the control panel 331 provided on the drawer panel 33.

In other words, when the user inputs a course for performing washing, rinsing, dehydration, drying or the like using the control panel 331 or the like, the controller 37 may be previously configured to perform an algorithm of supplying or discharging water to or from the tub 4 of the laundry treatment apparatus 100, rotating the drum 5, or supplying steam or hot air to the tub 4.

At this time, the controller 37 may perform a sensing step S2 of controlling the sensing unit 400 so as to sense whether or not the drawer 3 is completely inserted into the cabinet 2.

The fact that the drawer 3 is completely inserted into the cabinet 2 means that the insertion of the drawer 3 into the cabinet 2 is completed. That is, this is the state in which the drawer panel 33 completely closes the opening 21 of the cabinet 2.

When it is not sensed in the sensing step S2 that the drawer 3 is inserted into the cabinet 2, a predetermined standby time may be provided for completion of insertion of the drawer 3 into the cabinet 2.

At this time, a first notification step S2-1 may be performed to display the fact that the drawer 3 is not completely inserted into the cabinet 2 on the display unit 331 via a warning sound, lighting or the like so as to induce the user to completely insert the drawer 3 into the cabinet 2.

This is because, when the fastening unit 300 locks the drawer 3 in the state in which the drawer 3 is not completely accommodated in the cabinet 2, the drawer 3 or the fastening unit 300 may be damaged and the discharge or insertion of the drawer 3 may be obstructed.

In addition, when the laundry treatment apparatus 100 begins to operate before the drawer 3 is completely inserted into the cabinet 2, there is a high risk of occurrence of the accident described above.

Thus, the sensing step S2 may be referred to as the most basic step for preventing accidents in the operation of the laundry treatment apparatus 100.

When it is sensed via the sensing unit 400 in the sensing step S2 that the drawer 3 is completely inserted into the cabinet 2, the controller 37 may perform a locking step S3 of controlling the fastening unit 300 so as to lock the drawer 3 so that the drawer 3 is fixed to the cabinet 2 without the risk of discharge.

Of course, although the controller may control the fastening unit 300 so as to fix the drawer 3 to the cabinet 2 upon receiving a signal from the sensing unit 400, the user may control a locking input device (not illustrated), which is separately provided on the laundry treatment apparatus 100, so as to directly fix the drawer 3 to the cabinet 2 using the fastening unit 300. Even in this case, it is to be noted that the drawer 3 needs to be completely inserted into the cabinet 2.

When the locking of the drawer 3 is completed in the locking step S3, an implementation step S4 in which the laundry treatment apparatus 100 performs the input control command may be performed.

As described above, the control command may correspond to any one of washing, rinsing, dehydration, and drying processes input by the user, or may correspond to at least one of the supply or discharge of water to or from the tub 4, the rotation of the drum 5, and the supply of steam or hot air to the tub 4 in order to perform a combined course of the aforementioned processes.

The controller 37 may perform a step S5 of determining whether or not the implementation of the control command is completed. When the implementation of the control command is completed, the controller 37 may perform a locking release step S7 of controlling the fastening unit 300 so as to release the locking so that the drawer 3 may be separated from the cabinet 2.

As such, the drawer 3 is locked to the cabinet 2 during the operation of the laundry treatment apparatus 100 so as to prevent any accident.

In addition, when the operation of the laundry treatment apparatus 100 is completed, the locking of the drawer 3 to the cabinet 2 may be automatically released, which may maximize the convenience of use.

Meanwhile, at the time at which the implementation of the control command is completed, the temperature inside the tub 4 may be a reference temperature or more due to the implementation of a specific control command.

For example, when the control command is given to supply hot water to the tub 4, to heat the water inside the tub 4, or to supply steam or hot air to the tub 4, the temperature inside the tub 4 may remain at a reference temperature or more even at the time at which the control command is completed.

At this time, the user may be exposed to hot air and be burned when the fastening unit 300 is controlled to release the locking of the drawer 3 so that the drawer 3 is discharged from the cabinet 2.

Therefore, the controller may perform a step S6 of receiving information from a temperature sensor (not illustrated) so as to sense whether or not the temperature inside the tub 4 is a reference temperature or more, prior to performing the locking release step S7.

As described above, the reference temperature corresponds to the temperature at which the user may be physically or mentally damaged by hot air.

At this time, when the temperature inside the tub 4 is the reference temperature or more, the locking of the drawer 3 may be maintained until the temperature inside the tub 4 is less than the reference temperature.

At this time, the controller may issue a command to operate a blowing fan, a command for standby for a predetermined time, and/or a command to temporarily supply cold water so that the temperature inside the tub 4 is less than the reference temperature.

In addition, the control command may include only the supply of water without the discharge of water, rather than the entire implementation of at least one of the washing, rinsing, dehydration, and drying processes.

In one example, the control command may correspond to the implementation of a specific washing course, and the specific washing course may include supplying water to the tub 4, and thereafter rotating the drum 5 for a predetermined time. In another example, the control command may correspond to the implementation of a specific washing course, and the specific washing course may include supplying water to the tub 4 and rotating the drum 5 so as to perform only rinsing, or may include supplying water to the tub 4 and operating only the heater 411 to soften dirt on laundry.

As described above, the case where the water inside the tub 4 is not completely discharged even when the control command is completed may occur.

Thus, even if the temperature inside the tub 4 is less than the reference temperature before the locking release step S7 is performed, the level of water inside the tub 4 may be a reference water level or more.

As described above, the reference water level may be the level of water at which the cabinet 2 may be turned over by the weight of the tub 4 when the drawer 3 is discharged from the cabinet 2.

The controller may control the water-level sensor unit 600 so that the locked state is maintained when the level of water inside the tub 4 is the reference water level.

Moreover, the laundry treatment apparatus 100 may completely discharge the water inside the tub 4 when the level of water inside the tub 4 is the reference water level or more after the control command is completed.

Thus, the locking release step S7 may be performed in the case where the level of water inside the tub 4 is below the reference water level.

Through the control method described above, when the laundry treatment apparatus is operating, the locking operation of fixing the drawer 3 to the cabinet 2 may be performed and the locked state may be maintained. In addition, when the operation of the laundry treatment apparatus is completed and there is no risk of an accident, the locked state may be released so as to allow the drawer 3 to be separated from the cabinet 2.

Thereby, the safety and convenience of the drawer-type laundry treatment apparatus 100 may be maximized.

Meanwhile, even when a control command is input to the laundry treatment apparatus 100 and the laundry treatment apparatus 100 is operating, the user may have the intention to discharge the drawer 3 from the cabinet 2.

For example, the user may have the intention to discharge the drawer 3 so as to input additional laundry or to input detergent or fabric softener while the laundry treatment apparatus 100 is operating.

When the discharge of the drawer 3 from the cabinet 2 is not permitted or is completely blocked even in this case, the user may become incapable of freely performing a desired manipulation.

However, when the discharge of the drawer 3 is permitted whenever the user's intention is input in consideration only of the user's wishes, there is the risk of occurrence of the accident described above.

When the user intention to discharge the drawer 3 from the cabinet 2 is input during the implementation of the control command, the laundry treatment apparatus 100 may need to determine whether or not a locking release condition of the drawer having no risk of the occurrence of an accident is satisfied, or may need to perform a release measure of satisfying the locking release condition so as to enable the discharge of the drawer 3 from the cabinet 2.

To this end, when the control command is performed so that the locking step of causing the fastening unit 300 to fix the drawer 3 to the cabinet 2 is in progress, the laundry treatment apparatus 100 or the controller may perform a step S4-1 of sensing whether or not such a user's intention to discharge the drawer 3 to the cabinet 2 has been input due to the user's desire to release the locked state.

To this end, the laundry treatment apparatus 100 may include the input unit 500, which receives a signal to separate the drawer 3 from the cabinet 2. The input unit 500 may be any one of the load sensor 510, the pause button 520, and the locking-release button 530 described above. That is, the user's intention to discharge the drawer 3 from the cabinet 2 may be input by the input unit 500 to the laundry treatment apparatus 100.

For example, when the user grips the grip 311 of the drawer 3 and applies pressure thereto, the load sensor 510 provided on the grip 311 may sense the pressure, and thus the laundry treatment apparatus 100 may be made aware of the user's intention. In addition, when the user pushes the pause button 520, this may be interpreted as the user's intention to discharge the drawer 3. In addition, when the user pushes the locking-release button 530, this may be interpreted as the user's intention to discharge the drawer 3.

As such, when the user's intention (signal) is input via the input unit 500 before the implementation of the control command is completed, the laundry treatment apparatus 100 may perform a step S4-2 of controlling the fastening unit 300 so as to determine whether or not the locking release condition under which the drawer 3 may be separated from the cabinet 2 is satisfied.

The locking release condition may correspond to at least one of the state in which the rotation of the drum 5 stops, the state in which water is completely supplied to or discharged from the tub 4, the state in which the supply of steam or hot air to the tub 4 stops, the state in which the level of water inside the tub 4 is below a reference water level, and the state in which the temperature inside the tub 4 is below a reference temperature.

However, the above-described locking release condition may be the condition under which all of the state in which the rotation of the drum 5 stops, the state in which water is completely supplied to or discharged from the tub 4, the state in which the supply of steam or hot air to the tub 4 stops, the state in which the level of water inside the tub 4 is below a reference water level, and the state in which the temperature inside the tub 4 is below a reference temperature are satisfied.

When the user's intention is input to the input unit 500, but the current state does not correspond to the locking release condition, the laundry treatment apparatus 100 may perform a step S4-3 of maintaining the locked state so as to fix the drawer 3 to the cabinet 2 without the risk of discharge.

That is, when the state of the inside of the drawer 3 does not satisfy the locking release condition, the controller 37 may not permit the discharge of the drawer 3.

However, the laundry treatment apparatus 100 may be incorrectly diagnosed as having failed when the drawer 3 is not discharged despite the user's intention to discharge the drawer 3.

To prevent this problem, when the locked state is maintained, the laundry treatment apparatus 100 may perform a second notification step S4-4 of controlling the display unit 311 so as to indicate that the discharge of the drawer 3 is rejected.

However, even if the locked state is maintained, the user may continuously have the intention to discharge the drawer 3 from the cabinet 2. That is, a signal may be additionally input to the input unit 500 within a predetermined time. This is because the user may have no time to input laundry unless the user does not input additional laundry immediately, or because washing may not be completed unless detergent or fabric softener is input immediately.

That is, the laundry treatment apparatus 100 may perform a repetitive locking-release request sensing step S4-5 of determining whether or not a signal to discharge the drawer 3 from the cabinet 2 or a signal to separate the drawer 3 from the cabinet 2 is additionally input via the input unit 500 even when the locking release condition is not satisfied and the locked state is maintained.

When the signal is additionally input via the input unit 500 in the repetitive locking-release request sensing step, the laundry treatment apparatus 100 may perform a release-condition implementation step S4-6 of satisfying the locking release condition.

In the release-condition implementation step S4-6, to satisfy the locking release condition, at least one of or all of the stoppage of rotation of the drum 5, standby for a predetermined time until the temperature inside the tub 4 is less than a reference temperature, the operation of the blowing fan, the supply of cold water, the discharge of water until the level of water inside the tub 4 is less than a reference water level, and the stoppage of supply of steam or hot air to the tub 4 may be performed.

When the release-condition implementation step S4-6 is completed, the controller 37 may perform a temporary locking release step S4-7 of controlling the fastening unit 300 so as to temporarily release the locking of the drawer 3 to the cabinet 2.

When the temporary locking release step S4-7 is performed, the laundry treatment apparatus 100 may perform a step S4-8 of controlling the sensing unit 400 so as to sense whether or not the drawer 3 is discharged from the cabinet 2 and then is again inserted, and may perform a locking re-implementation step S4-9 of again fixing the drawer 3 to the cabinet 2 when the drawer 3 is discharged and then is again inserted.

In addition, when no signal to discharge the drawer 3 from the cabinet 2 is input for a predetermined time after the temporary locking release step S4-7 is performed, the laundry treatment apparatus 100 may perform a step S4-8' of controlling the sensing unit 400 so as to determine whether or not the discharge of the drawer 3 from the cabinet 2 is sensed within a predetermined time. When the discharge of the drawer 3 is not sensed within a predetermined time, the laundry treatment apparatus 100 may perform the locking re-implementation step S4-9 of controlling the fastening unit 300 so as to again fix the drawer 3 to the cabinet 2.

This serves to prevent the implementation of the control command from being delayed even when it is determined that the user has no intention to discharge the drawer 3 based on the fact that the drawer 3 is not discharged for a predetermined time.

When the locking re-implementation step S4-9 is performed, the laundry treatment apparatus 100 may return to the state before the release of locking was requested and may perform the pre-input control command.

That is, the controller 37 may determine whether or not the implementation of the control command is completed and may perform the implementation step S4 upon determining that the implementation of the control command is not completed.

Meanwhile, the pre-input control command may again be implemented when no user's intention to discharge the drawer 3 is input to the input unit 500 for a predetermined time in the repetitive locking-release request step.

In addition, in the repetitive locking-release request step S4-5, the control command that has been implemented may be continuously implemented until the user's intention to discharge the drawer 3 is input to the input unit 500.

This is because excessive time may be consumed when the control command is not performed in the situation in which there is the possibility of the user not repeatedly requesting the release of locked state.

Meanwhile, the door 45 may be opened by various factors such as vibration of the drum 5 or the like while the implementation step S4 is being performed in the state in which the drawer 3 is completely accommodated in the cabinet 2.

When the door 45 is opened, water, laundry, detergent and the like accommodated in the tub 4 or the drum 5 may be discharged outward from the drawer cover 35.

The discharged water, laundry, detergent and the like may contaminate the drawer 3, and may cause corrosion inside the laundry treatment apparatus 100 as well as accidents such as short-circuits. Therefore, when the door 45 is opened while the implementation step S4 is performed, it is necessary to induce the user to discharge the drawer 3 and then close the door 45.

Thus, when the door 45 is opened while the implementation step S4 is performed, it is necessary to stop the operation of the laundry treatment apparatus 100 and to induce the user to safety discharge the drawer 3.

To this end, the controller 37 may need to stop the operation of the laundry treatment apparatus 100, release the locking of the drawer 3, and induce the user to close the door 45 when it is sensed via the sensing unit 400 that the door 45 opens the introduction aperture 431 while the implementation step S4 is performed (or before the implementation step S4 is completed).

However, even in this case, the controller 37 needs to perform the release condition implementation step S4-6 because the above-described accidents may occur when the discharge of the drawer 3 is unconditionally permitted.

Specifically, the controller 37 may perform a door opening sensing step S4' of sensing whether or not the door 45 opens the introduction aperture 431 using the sensing unit 400 before the implementation step S4 is completed.

At this time, when the sensing unit 400 senses that the door 45 is opened, the controller 37 may perform a third notification step S4'-1 of informing the user that the door 45 is opened via the display unit 331.

Thereafter, the controller 37 may perform the release-condition implementation step S4-6 so as to allow the user to discharge the drawer 3 and close the door 45.

The release-condition implementation step S4-6 serves to satisfy the locking release condition.

As described above, the locking release condition may include at least one of the state in which the drum 5 stops, the state in which the temperature inside the tub 4 is below a reference temperature, the state in which the level of water in the tub 4 is below a reference water level, and the state in which the supply of hot air or steam to the tub 4 stops. The release-condition implementation step S4-6 may include stopping the rotation of the drum 5, standing by for a predetermined time until the temperature inside the tub 4 is less than the reference temperature, operating the blowing fan, supplying cold water, discharging the water until the level of water inside the tub 4 is less than the reference temperature, and/or stopping the supply of hot air or steam to the tub 4.

When the release condition implementation step S4-6 is completed, the controller 37 may perform the temporary locking release step S4-7 of controlling the fastening unit 300 so as to temporarily release the locking of the drawer 3 to the cabinet 2.

As such, the user may discharge the drawer 3 from the cabinet 2 and then close the door 45.

In the temporary locking release step S4-7 in which the door 45 opens the introduction aperture 431, the locking re-implementation step S4-9 is not performed even if a predetermined time passes in the state in which the drawer 3 is not discharged from the cabinet 2. This is because it is more important to prevent accidents caused when the door 45 is opened, than to prevent the delay of the implementation step S4.

Meanwhile, the controller 37 may perform a door-closing-sensing step S4'-8 of controlling the sensing unit 400 so as to sense whether or not the door 45 closes the introduction aperture 431 when the sensing unit 400 senses that the drawer 3 is again inserted into the cabinet 2. This is because the door 45 may not completely close the introduction aperture 431 even if the discharged drawer 3 is again inserted.

When it is sensed in the door-closing-sensing step S4'-8 that the door 45 closes the introduction aperture 431, the controller 37 performs a locking re-implementation step of controlling the fastening unit 300 so as to again fix the drawer 3 to the cabinet 2.

When the locking re-implementation step is performed, the controller 37 may return to the state in which the door 45 is opened and may perform the pre-input control command.

However, when it is sensed via the sensing unit 400 in the door-closing-sensing step S4'-8 that the door 45 continuously opens the introduction aperture 431, the controller 37 may return to the third notification step S4'-1 so as to repeat the above-described process.

As is apparent from the above description, the present invention has the effect of providing a method of controlling a drawer-type laundry treatment apparatus, which may perform the locking of a drawer by sensing whether the drawer is completely inserted into a cabinet.

The present invention has the effect of providing a method of controlling a drawer-type laundry treatment apparatus, which may perform the locking of a drawer so as to ensure that the drawer is fixed to and is not separated from the cabinet during operation of the laundry treatment apparatus such as, for example, during the supply or discharge of water to or from a tub, during steam or hot air supply, or during drum rotation.

The present invention has the effect of providing a method of controlling a drawer-type laundry treatment apparatus, which may release the locking of a drawer so as to allow the drawer to be discharged from the cabinet when the operation of the laundry treatment apparatus, such as the supply or discharge of water to or from a tub, the supply of steam or hot air, or the rotation of a drum, is completed.

The present invention has the effect of providing a method of controlling a drawer-type laundry treatment apparatus, which may determine whether or not to permit the discharge of a drawer in consideration of the possibility of occurrence of an accident when sensing the user's intention to discharge the drawer during the operation of the laundry treatment apparatus.

The present invention has the effect of providing a method of controlling a drawer-type laundry treatment apparatus, which may maintain the locking of a drawer based on the determination that there is the risk of an accident when sensing the user's intention to discharge the drawer during the operation of the laundry treatment apparatus.

The present invention has the effect of providing a method of controlling a drawer-type laundry treatment apparatus, which may remove risk factors that may cause accidents, and may permit the discharge of a drawer when sensing the user's intention to discharge the drawer during the operation of the laundry treatment apparatus.

The present invention has the effect of providing a method of controlling a drawer-type laundry treatment apparatus, which may release the locking of a drawer and may secure the autonomy of the user based on the determination that there is no possibility of occurrence of an accident when sensing the user's intention to discharge the drawer during the operation of the laundry treatment apparatus.

The present invention has the effect of providing a method of controlling a drawer-type laundry treatment apparatus, which may prevent accidents and damage to the laundry treatment apparatus by sensing whether a door, which is used to open or close the inlet of a tub, is opened or closed during the operation of the laundry treatment apparatus, and inducing a user to close the door.

Although the exemplary embodiments have been illustrated and described as above, of course, it will be apparent to those skilled in the art that the embodiments are provided to assist understanding of the present invention and the present invention is not limited to the above described particular embodiments, and various modifications and variations can be made in the present invention without departing from the spirit or scope of the present invention, and the modifications and variations should not be understood individually from the viewpoint or scope of the present invention.

What is claimed is:

1. A control method of a laundry treatment apparatus comprising a cabinet defining an external appearance of the laundry treatment apparatus, a drawer configured to withdraw from the cabinet, a tub accommodated in the drawer and configured to receive wash water, a drum rotatably provided inside the tub and configured to receive laundry, a fastening unit configured to separably couple the drawer to the cabinet, and a sensing unit configured to detect whether the drawer is withdrawn from or inserted to the cabinet, the control method comprising:

receiving a control command to operate the laundry treatment apparatus;

sensing completion of insertion of the drawer into the cabinet based on output from the sensing unit;

receiving the control command or sensing the completion of insertion of the drawer into the cabinet locks the drawer to the cabinet by controlling the fastening unit; detecting that at least a portion of the drawer is withdrawn from the cabinet prevents operation of the fastening unit to avoid attempting to lock the drawer to the cabinet while the portion of the drawer is withdrawn from the cabinet; performing an operation corresponding to the control command; and releasing the drawer from the cabinet by controlling the fastening unit based on completion of the operation.

2. The control method according to claim 1, wherein the operation comprises one or more of rotating the drum, supplying hot air to the tub, supplying steam to the tub, supplying water to the tub, or discharging water from the tub.

3. The control method according to claim 1, wherein releasing the drawer from the cabinet comprises releasing the drawer from the cabinet based on determining that a water temperature in the tub is less than a reference temperature or that a water level in the tub is below a reference water level.

4. The control method according to claim 1, wherein locking the drawer to the cabinet is not performed until the completion of insertion of the drawer to the cabinet based on detecting that at least the portion of the drawer is withdrawn from the cabinet.

5. The control method according to claim 1, wherein the laundry treatment apparatus further comprises a display unit configured to display or notify a state of the laundry treatment apparatus, and wherein the control method further comprises displaying on the display unit a first notification indicating that the drawer is withdrawn.

6. The control method according to claim 5, wherein the laundry treatment apparatus further comprises an input unit configured to receive a first signal corresponding to a request to separate the drawer from the cabinet, and wherein the control method further comprises determining, based on receiving the first signal from the input unit before completion of performing the operation, whether a locking release condition is satisfied to allow the drawer to be separated from the cabinet by controlling the fastening unit.

7. The control method according to claim 6, wherein the locking release condition comprises one or more states including:

a state in which rotation of the drum is stopped, a state in which a temperature inside the tub is less than a reference temperature, a state in which a water level inside the tub is below a reference water level, and a state in which supply of hot air or steam to the tub is stopped.

8. The control method according to claim 7, wherein the laundry treatment apparatus further comprises a display unit configured to display or notify a state of the laundry treatment apparatus, and wherein the control method further comprises, based on determining that the locking release condition is not satisfied, maintaining the drawer locked to the cabinet and displaying a second notification on the display unit indicating that the request to separate the drawer from the cabinet is rejected.

9. The control method according to claim 8, further comprising determining whether a second signal corresponding to a second request to separate the drawer from the cabinet is received from the input unit within a predetermined time while maintaining the drawer locked to the cabinet based on determining that the locking release condition is not satisfied.

10. The control method according to claim 9, further comprising satisfying the locking release condition based on receiving the second signal from the input unit, wherein satisfying the locking release condition comprises one or more of stopping rotation of the drum, stopping supplying hot air or steam to the tub, waiting until the temperature inside the tub becomes less than the reference temperature, operating a blowing fan, supplying cold water to tub, or discharging water from the tub to decrease the water level inside the tub below the reference water level.

11. The control method according to claim 10, further comprising releasing the drawer from the cabinet by controlling the fastening unit based on completion of satisfying the locking release condition.

12. The control method according to claim 1, further comprising relocking the drawer to the cabinet by controlling the fastening unit based on determining that the drawer has withdrawn from the cabinet and then inserted into the cabinet, or based on elapsing a predetermined time without detecting that the drawer is withdrawn from the cabinet.

13. The control method according to claim 12, wherein performing the operation comprises performing the operation based on relocking the drawer to the cabinet.

14. The control method according to claim 1, wherein the laundry treatment apparatus defines an introduction aperture at an upper surface of the tub, and a door provided on the drawer or the tub and configured to open and close the introduction aperture, wherein the sensing unit is further configured to detect whether the door opens or closes the introduction aperture, and wherein the control method further comprises detecting, based on output from the sensing unit, whether the door opens the introduction aperture before completion of performing the operation.

15. The control method according to claim 14, wherein the laundry treatment apparatus further comprises a display unit configured to display or notify a state of the laundry treatment apparatus, and wherein the control method further comprises displaying a third notification on the display unit indicating that the door is open based on the sensing unit detecting that the door opens the introduction aperture.

16. The control method according to claim 15, further comprising satisfying a locking release condition to allow the drawer to withdraw from the cabinet based on the sensing unit detecting that the door opens the introduction aperture.

17. The control method according to claim 16, further comprising releasing the drawer from the cabinet by controlling the fastening unit based on completion of satisfying the locking release condition.

18. The control method according to claim 17, further comprising detecting whether the door closes the introduction aperture based on the sensing unit detecting that the drawer has withdrawn from and then inserted to the cabinet.

19. The control method according to claim 18, further comprising:

relocking the drawer to the cabinet by controlling the fastening unit based on the sensing unit detecting that the door closes the introduction aperture, and repeating display of the third notification on the display unit based on the sensing unit detecting that the door opens the introduction aperture.

20. The control method according to claim 16, wherein satisfying the locking release condition comprises one or more of stopping rotation of the drum, stopping supplying hot air or steam to the tub, waiting until a temperature inside the tub becomes less than a reference temperature, operating a blowing fan, supplying cold water to the tub, or discharging water from the tub to decrease a water level inside the tub below a reference water level.

* * * * *